US012467328B2

(12) United States Patent
Bryant et al.

(10) Patent No.: US 12,467,328 B2
(45) Date of Patent: Nov. 11, 2025

(54) DOWNHOLE RELEASE TOOL WITH INTEGRATED IGNITER AND METHOD OF USING SAME

(71) Applicant: GR Energy Services Management, LP, Sugar Land, TX (US)

(72) Inventors: Cameron Michael Bryant, Sugar Land, TX (US); James William Anthony, Missouri City, TX (US); Jordan Joseph Faltemeier, Houston, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 18/566,576

(22) PCT Filed: Jun. 1, 2022

(86) PCT No.: PCT/US2022/031841

§ 371 (c)(1),
(2) Date: Dec. 1, 2023

(87) PCT Pub. No.: WO2022/256454

PCT Pub. Date: Dec. 8, 2022

(65) Prior Publication Data

US 2024/0254848 A1 Aug. 1, 2024

Related U.S. Application Data

(60) Provisional application No. 63/195,551, filed on Jun. 1, 2021.

(51) Int. Cl.
*E21B 23/06* (2006.01)
*E21B 23/04* (2006.01)

(52) U.S. Cl.
CPC ..... *E21B 23/065* (2013.01); *E21B 23/04* (2013.01); *E21B 23/0414* (2020.05)

(58) Field of Classification Search
CPC ..... E21B 23/065; E21B 23/04; E21B 23/06; E21B 33/12; E21B 23/0414; E21B 43/1185
See application file for complete search history.

(56) References Cited

U.S. PATENT DOCUMENTS 2,409,811 A 10/1946 Taylor et al.
2,705,159 A 3/1955 Pfau
(Continued)

OTHER PUBLICATIONS

GR Energy Services, ZipSet Setting Tool, GR-PUB031-20180103, dated Jan. 3, 2018, p. 1.
(Continued)

*Primary Examiner* — Yong-Suk (Philip) Ro
(74) *Attorney, Agent, or Firm* — JL Salazar

(57) ABSTRACT

A release tool for releasing a downhole portion a downhole tool, including a release housing, top and bottom subs, a release assembly, and an integrated igniter. The top sub and bottom subs connected to the downhole tool. The release assembly including a release mandrel and a locking mechanism. The release mandrel is operatively connected to the top sub and the bottom sub, and releasably secures the release assembly to the bottom sub. The integrated igniter includes an integrator housing, a switch assembly, and an internal propellant. The switch assembly is operatively connected to the internal propellant whereby, upon triggering the switch, the internal propellant is ignited to release an ignition fluid under ignition pressure to unlock the locking mechanism and release the downhole portion of the downhole tool from the uphole portion of the downhole tool.

21 Claims, 25 Drawing Sheets

(56) References Cited

U.S. PATENT DOCUMENTS

| | | | | |
|---|---|---|---|---|
| 3,024,843 | A | 3/1962 | Vaughan | |
| 3,062,292 | A * | 11/1962 | Lowrey | E21B 23/06 166/134 |
| 3,211,222 | A | 10/1965 | Myers | |
| 3,713,393 | A | 1/1973 | O'Connor et al. | |
| 3,966,236 | A | 6/1976 | Vann | |
| 4,776,393 | A * | 10/1988 | Forehand | E21B 23/04 166/377 |
| 5,242,201 | A | 9/1993 | Beeman | |
| 5,984,006 | A | 11/1999 | Read et al. | |
| 6,095,583 | A | 8/2000 | Beeman et al. | |
| 6,431,269 | B1 | 8/2002 | Post et al. | |
| 6,450,541 | B1 | 9/2002 | Bakke | |
| 6,520,089 | B1 | 2/2003 | Avanci et al. | |
| 7,198,101 | B2 | 4/2007 | McGarian et al. | |
| 7,409,987 | B2 | 8/2008 | Fjelde | |
| 8,267,012 | B2 | 9/2012 | Peeters et al. | |
| 8,960,093 | B2 | 2/2015 | Preiss et al. | |
| 9,581,422 | B2 | 2/2017 | Preiss et al. | |
| 9,605,937 | B2 | 3/2017 | Eitschberger et al. | |
| 9,810,035 | B1 | 11/2017 | Carr et al. | |
| 9,822,596 | B2 | 11/2017 | Clemens et al. | |
| 9,822,618 | B2 | 11/2017 | Eitschberger | |
| 9,915,513 | B1 | 3/2018 | Zemla et al. | |
| 10,036,236 | B1 | 7/2018 | Sullivan et al. | |
| 10,309,199 | B2 | 6/2019 | Eitschberger | |
| 10,365,079 | B2 | 7/2019 | Harrington et al. | |
| 10,507,433 | B2 | 12/2019 | Eitschberger et al. | |
| 10,689,931 | B2 | 6/2020 | Mickey et al. | |
| 10,844,678 | B2 | 11/2020 | Mickey et al. | |
| 10,858,919 | B2 | 12/2020 | Anthony et al. | |
| 11,078,763 | B2 | 8/2021 | Anthony et al. | |
| 2004/0134667 | A1 | 7/2004 | Brewer et al. | |
| 2006/0048940 | A1 * | 3/2006 | Hromas | E21B 43/116 166/55 |
| 2013/0008669 | A1 | 1/2013 | Deere et al. | |
| 2014/0033939 | A1 | 2/2014 | Priess et al. | |
| 2015/0247368 | A1 * | 9/2015 | Clemens | E21B 23/00 166/243 |
| 2015/0345922 | A1 | 12/2015 | Lanclos et al. | |
| 2016/0061572 | A1 | 3/2016 | Eitschberger et al. | |
| 2016/0115753 | A1 | 4/2016 | Frazier et al. | |
| 2016/0356132 | A1 | 12/2016 | Burmeister et al. | |
| 2017/0030693 | A1 | 2/2017 | Preiss et al. | |
| 2017/0074078 | A1 | 3/2017 | Eitschberger | |
| 2018/0038208 | A1 | 2/2018 | Eitschberger | |
| 2018/0080298 | A1 | 3/2018 | Covalt et al. | |
| 2018/0224260 | A1 | 8/2018 | Zemla et al. | |
| 2018/0258724 | A1 * | 9/2018 | Massey | E21B 31/1075 |
| 2018/0299239 | A1 | 10/2018 | Eitschberger et al. | |
| 2019/0086189 | A1 | 3/2019 | Eitschberger et al. | |
| 2019/0106969 | A1 | 4/2019 | Sullivan et al. | |
| 2019/0127290 | A1 | 5/2019 | Löhken et al. | |
| 2019/0178045 | A1 | 6/2019 | Frazier et al. | |
| 2019/0234189 | A1 | 8/2019 | Preiss | |
| 2019/0242209 | A1 | 8/2019 | Anthony et al. | |
| 2019/0242222 | A1 | 8/2019 | Eitschberger | |
| 2019/0330947 | A1 * | 10/2019 | Mulhern | E21B 23/0414 |
| 2019/0376775 | A1 | 12/2019 | Preiss et al. | |
| 2020/0024935 | A1 | 1/2020 | Eitschberger et al. | |
| 2020/0048996 | A1 | 2/2020 | Anthony et al. | |
| 2020/0063537 | A1 | 2/2020 | Langford et al. | |
| 2020/0072029 | A1 | 3/2020 | Anthony et al. | |
| 2020/0182025 | A1 | 6/2020 | Brady | |
| 2020/0256166 | A1 | 8/2020 | Knight et al. | |
| 2020/0277837 | A1 | 9/2020 | Hern et al. | |
| 2020/0362652 | A1 | 11/2020 | Eitschberger et al. | |
| 2021/0040805 | A1 | 2/2021 | Kehoe et al. | |
| 2021/0123311 | A1 | 4/2021 | Rosenthal | |
| 2022/0145732 | A1 | 5/2022 | Anthony et al. | |
| 2024/0254846 | A1 | 8/2024 | Bryant et al. | |
| 2024/0254847 | A1 | 8/2024 | Bryant et al. | |
| 2024/0254849 | A1 | 8/2024 | Bryant et al. | |

OTHER PUBLICATIONS

PCT International Search Report and Written Opinion dated Aug. 25, 2022, pp. 1-13.

* cited by examiner

DOWNHOLE RELEASE TOOL WITH INTEGRATED IGNITER AND METHOD OF USING SAME

CROSS-REFERENCE TO RELATED APPLICATIONS

This application claims the benefit of U.S. Provisional Application No. 63/195,551, the entire contents of which is hereby incorporated by reference herein to the extent not inconsistent with the present disclosure. Applicant also filed U.S. Provisional Application Nos. 63/195,521; 63/195,540; and 63/222,578 on Jun. 1, 2022, the entire contents of each of which are hereby incorporated by reference herein to the extent not inconsistent with the present disclosure.

BACKGROUND

The present disclosure relates generally to oilfield technology. More specifically, the present disclosure relates to downhole tools and downhole activators.

Wellsite operations are performed to locate and access subsurface targets, such as valuable hydrocarbons. Drilling equipment is positioned at the surface and downhole drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

During the wellsite operations, various downhole tools, may be deployed into the earth to perform various procedures, such as measurement, perforation, injection, plugging, etc. Examples of downhole tools are provided in US Patent/Application Nos. 10200024935; U.S. Pat. No. 10,507,433; 20200277837; 20170376775; 20170330947; 20170576775; 20170530947; 20190242222; 20190234189; U.S. Pat. No. 10,309,199; 20190127290; 20190086189; 20190242209; 20180299239; 20180224260; U.S. Pat. No. 9,915,513; 20180038208; U.S. Pat. Nos. 9,822,618; 9,605,937; 20170074078; U.S. Pat. No. 9,581,422; 20170030693; 20160556132; 20160061572; U.S. Pat. No. 8,960,093; 20140033939; U.S. Pat. Nos. 8,267,012; 6,520,089; 20160115753; 20190178045; U.S. Pat. Nos. 10,365,079; 10,844,678; and 10,365,079, the entire contents of which are hereby incorporated by reference herein to the extent not inconsistent with the present disclosure. These downhole tools may be activated to perform the various procedures. Example procedures are provided in U.S. Pat. Nos. 11,078,763; 10,858,919; 10,036,236; 10,365,079; 7,409,987; 6,431,269; 3,713,393; 3,024,843; 2022/0145732; 2004/0134667; 20200072029; 20200048996; 20150345922; and 20160115753, the entire contents of which are hereby incorporated by reference herein to the extent not inconsistent with the present disclosure.

Despite advancements in downhole technology, there remains a need for efficient techniques for reliably connecting, releasing, and/or activating downhole tools, even in harsh and/or compact downhole environments. The present disclosure is directed at providing such needs.

SUMMARY

In at least one aspect, the disclosure relates to a release tool for releasing a downhole portion a downhole tool, comprising a release housing, a top sub, a bottom sub, a release assembly and an integrated igniter. The release housing has a passage therethrough. The top sub is positioned at an uphole end of the release housing. The top sub is connected to an uphole portion of the downhole tool. The bottom sub is positioned at a downhole end of the release housing. The bottom sub is connected to the downhole portion of the downhole tool. The release assembly is positioned in the passage. The release assembly comprises a release mandrel and a locking mechanism, the release mandrel is operatively connected to the top sub and the bottom sub. The locking mechanism releasably secures the release assembly to the bottom sub. The integrated igniter positioned in the passage. The integrated igniter comprises an integrator housing, a switch assembly, and an internal propellant. The switch assembly is operatively connected to the internal propellant whereby, upon triggering the switch, the internal propellant is ignited to release an ignition fluid under ignition pressure to unlock the locking mechanism and release the downhole portion of the downhole tool from the uphole portion of the downhole tool.

In another aspect, the disclosure relates to a downhole tool, comprising: an uphole portion, a downhole portion, and a release tool. The release tool comprising a release housing, a top sub, a bottom sub, a release assembly and an integrated igniter. The release housing has a passage therethrough. The top sub is positioned at an uphole end of the release housing. The top sub is connected to an uphole portion of the downhole tool. The bottom sub is positioned at a downhole end of the release housing. The bottom sub is connected to the downhole portion of the downhole tool. The release assembly is positioned in the passage. The release assembly comprises a release mandrel and a locking mechanism, the release mandrel is operatively connected to the top sub and the bottom sub. The locking mechanism releasably secures the release assembly to the bottom sub. The integrated igniter positioned in the passage. The integrated igniter comprises an integrator housing, a switch assembly, and an internal propellant. The switch assembly is operatively connected to the internal propellant whereby, upon triggering the switch, the internal propellant is ignited to release an ignition fluid under ignition pressure to unlock the locking mechanism and release the downhole portion of the downhole tool from the uphole portion of the downhole tool.

In another aspect, the disclosure relates to a method of releasing a portion of a downhole tool. The method comprises providing a release tool comprising a release housing, a release assembly, and an integrated ignitor, the release assembly and the integrated ignitor positioned in the release housing; connecting an uphole end of the release tool to an uphole portion of the downhole tool and a downhole end of the release tool to a downhole portion of the downhole tool; and selectively releasing the downhole portion of the downhole tool by triggering the integrated ignitor to release a fluid under pressure to unlock the release assembly such that the downhole portion of the downhole tool is released from the uphole portion of the downhole tool.

In at least one aspect, the disclosure relates to a release tool for releasing a portion a downhole tool. The release tool comprises a release housing; an integrated igniter; and a release assembly.

In another aspect, the disclosure relates to a downhole tool. The downhole tool comprises an uphole portion; a downhole portion; and a release tool connected to the uphole portion and releasably connected to the downhole portion.

In yet another aspect, the disclosure relates to a method of activating a release tool of a downhole tool. The method comprises positioning an integrated igniter into a release tool; positioning the release tool about the downhole tool;

positioning the downhole tool in a wellbore; and triggering the integrated igniter to ignite a propellant in the release tool.

Finally, in another aspect, the disclosure relates to a method of releasing a portion of a downhole tool. The method comprises providing a release tool; connecting the release tool between an uphole and a downhole portion of the downhole tool; positioning the downhole tool in a wellbore; and releasing the downhole portion of the downhole tool by activating the release tool with the integrated igniter.

In at least one aspect, the present disclosure also relates to an igniter for activating a downhole component of a downhole tool. The igniter comprises an igniter housing; a switch assembly; and a propellant. The switch assembly may comprise a single or dual switch. The propellant may be positioned outside of or within the igniter housing.

In another aspect, the present disclosure relates to a downhole tool comprising a downhole component, and an igniter for activating the downhole component. The igniter comprises an igniter housing; a switch assembly; and a propellant. The igniter may be an integrated igniter positioned within the downhole component, or a remote igniter positioned outside the downhole component.

The downhole tool may be a setting tool. The setting tool may be activated by inserting the igniter into the setting tool; deploying the setting tool with the integrated igniter into the wellbore; triggering the integrated igniter by passing a trigger signal from a surface unit to the switch assembly such that the switch assembly ignites the propellant to release a gas into the setting tool with sufficient force to advance a piston in the setting tool and deploy a plug assembly.

Finally, in another aspect, the disclosure relates to a method of activating a downhole component of a downhole tool, such as a release tool, a setting tool, or other downhole component. The method comprises positioning the igniter about the downhole tool; positioning the downhole tool in the wellbore; and triggering the igniter.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

Figure 1:
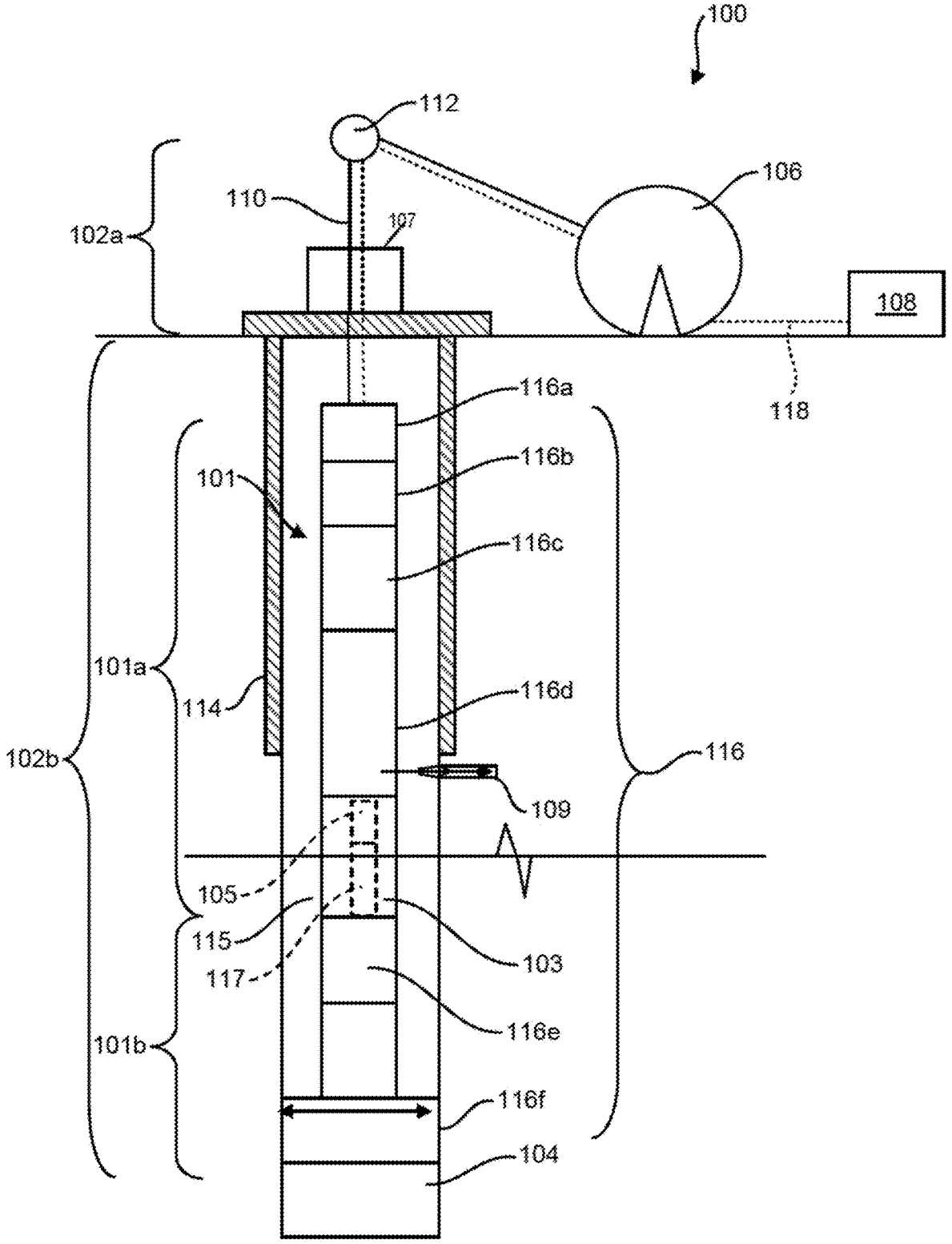
FIG. 1 is a schematic view of a wellsite with surface and downhole equipment, the downhole equipment comprising a downhole tool including a release tool with an integrated igniter.

The description that follows includes exemplary apparatus, methods, techniques, and/or instruction sequences that embody techniques of the present subject matter. However, it is understood that the described embodiments may be practiced without these specific details.

This disclosure relates to a release tool for releasing a portion of a downhole tool positionable in a wellbore at a wellsite. The release tool may include an integrated activator and a release assembly therein. The integrated activator may be an integrated igniter triggered to activate (e.g., shift, alter, drive, deploy, move, etc.) the release tool to release a downhole portion of the downhole tool into the wellbore. For example, the integrated igniter may be triggered from the surface to ignite a propellant within the release tool which activates the release tool to detach the downhole portion of the downhole tool in the wellbore.

The release tool may be a downhole component used to release a downhole portion of the downhole tool including one or more other downhole components. The combination of multiple downhole components formed into one assembly (e.g., a tool string) is referred to as a 'downhole tool.' The downhole tool may be a modular assembly including various combinations of multiple downhole components, such as a cable release, a collar locator, weight bars, a perforating tool (gun), a release tool, a setting tool, a plugging tool, an electronics hub, etc. One or more downhole components may be included in a single housing, or in separate housings of the downhole tool. The downhole components may be operatively (e.g., electrically and/or mechanically) connected together. One or more of the downhole components may operate separately or in concert.

The release tool may include a locking mechanism for selectively detaching a portion of the downhole tool, for example, during stuck in hole situations, maintenance, assembly, etc. The integrated igniter may be triggered to shift the locking mechanism (e.g., a sliding (release) sleeve and ball bearings (release balls)) from a locked to an unlocked position. In the unlocked position, an uphole portion of the downhole tool may be retrievable to the surface while a downhole portion of the downhole tool is free to fall into the wellbore.

The integrated igniter may be positioned within (e.g., integrated into) the release tool to enable pre-assembly of the release tool with the integrated activator therein, to enable quick connection/disconnection of downhole components connected downhole from the release tool, to provide a release tool usable with various combinations of various types of downhole tools/components, to provide a compact structure for use in restricted downhole spaces, etc. The release tool may also be provided with various configurations, such as various types of igniters or other activators (e.g., a single use, dual use, etc.) and various configurations of propellants (e.g., internal or external to the igniter, disc shaped, cylindrically shaped, etc.). The integrated igniter may also be removably positioned within the release tool to enable repair, replacement, and/or reuse of various integrated activators (igniters). The integrated igniter may be replaced with the same integrated igniter, or another type of integrated activator. This configuration may be used to provide a unitary release tool (with the integrated igniter pre-assembled therein) connectable to the downhole tool for use therewith.

The present disclosure seeks to provide one or more of the following features, among others: interchangeability with various tools, reduction in downtime, reduction in lost equipment, ability to remove portions of equipment, ability to preserve the integrity of/prevent damage to a conveyance (e.g., wireline), reliability, ballistic activation, operability in harsh downhole conditions, ease of manufacture and assembly, ability to couple to or integrate with existing components, operability with components of other tools for use therewith, reduction in cost, increased efficiency, elimination of redundant components, flexibility of use, ability to change configurations to match operational needs, ability to provide one or more activations, time savings, efficient operation, low maintenance costs, compact design, replaceable and/or disposable components, etc.

FIG. 1 is a schematic view of a wellsite 100 with surface equipment 102*a* and downhole equipment 102*b*, the downhole equipment 102*b* comprising a downhole tool 101 including a release tool 103 with an integrated igniter 105. The surface equipment 102*a* and the downhole equipment 102*b* are positioned about a wellbore 104 at the wellsite 100. The wellsite 100 may be any wellsite positioned about a subterranean formation, such as an unconventional formation (e.g., shale) with a reservoir (e.g., oil, gas, water, etc.) therein.

The surface equipment 102*a* includes a conveyance reel 106, and a surface unit 108. The surface equipment 102*a* may include a wellhead 107 (and other surface components) positioned about the top of the wellbore 104. The conveyance reel 106 may be a spool rotationally mounted at the surface. The conveyance reel 106 supports a conveyance 110 as it is deployed into the wellbore 104. A pulley 112 may optionally be provided to support the conveyance 110 about the wellbore 104 as schematically shown. In the example of FIG. 1, the conveyance 110 is a wireline cable electrically and communicatively coupled between the surface unit 108 and the downhole tool 101 for passing signals therebetween.

The downhole equipment 102*b* comprises the downhole tool 101 positioned in the wellbore 104 and supported therein by the conveyance 110. The wellbore 104 may have a casing 114 therein to line a surface of the wellbore 104. The downhole tool 101 may be deployed through the casing and into an open portion of the wellbore 104 via the conveyance 110 for performing downhole operations. The downhole tool 101 is provided with various downhole components 116 for performing such downhole operations.

FIG. 1 shows an example configuration of the downhole tool 101. In this example, the downhole tool 101 includes several downhole components 116 connected together to form a tool string. The downhole components 116 in this example include a cable head 116*a*, weight bars 116*b*, a collar locator 116*c*, a perforating tool 116*d*, a release tool 103, a setting tool 116*e*, and a plug assembly 116*f*. Various arrangements of one or more of the downhole components 116*a-f* (and/or other downhole components 116, such as electronics sub (not shown)) may be provided.

The downhole components 116 as shown are used to perform various downhole operations. The cable head 116*a* may operatively connect the downhole tool 101 to the conveyance 110. The weight bars 116*b* may be provided to add weight to the downhole tool 101. The collar locator 116*c* may be used to locate portions of the casing 114, or other items along the wellbore 104. As schematically shown, the perforating tool 116*d* may be used to launch shaped charges to form perforations 109 along the wall of the wellbore 104. Examples of perforating tools are provided in U.S. Pat. Nos. 10,036,236; 20200072029; and 20200048996, previously incorporated herein.

The setting tool 116*e* may be coupled to the plug assembly 116*f* for use therewith. The setting tool 116*e* may be activated to deploy a plug from the plug assembly 116*f* (as indicated by the double arrow) to anchor the downhole tool 101 along the wellbore 104. Examples of techniques for setting and plugging are described in U.S. Patent Application No. 20190242209; U.S. Pat. Nos. 10,365,079; 10,844,678; and 3,024,843, previously incorporated by reference herein.

The release tool 103 includes a release housing 115, a release assembly 117, and the integrated igniter 105. The release tool 103 may be activated by the integrated igniter 105 to perform a release operation to detach a downhole portion 101*b* of the downhole tool 101 as is described further herein. In the example shown in FIG. 1, the release tool 103 is positioned between the perforating tool 116*d* and the setting tool 116*e*. The release tool 103 is activated by the integrated igniter 105 to selectively release and detach the setting tool 116*e* and the plug assembly 116*f* into the wellbore 104.

The release tool 103 may be used with various configurations of the downhole tool 101 for releasing various of the downhole components 116. One or more release tools 103 and/or integrated igniters 105 (or other integrated activators) may be positioned in various locations about the downhole tool 101 for releasing one or more portions of the downhole tool 101 (e.g., the downhole portion 101*b*) into the wellbore 104. An uphole portion 101*a* of the downhole tool 101 may remain intact and suspended from the conveyance 110 upon release. Additional integrated (or other) igniters may also be positioned in other downhole components 116 for activation thereof.

The release tool 103 and/or the integrated igniter 105 may be communicatively coupled by a communication link 118 to the surface to receive signals therefrom. In the example shown in FIG. 1, the communication link 118 extends from the surface unit 108 and to the downhole tool 101 via the conveyance 110. The communication link 118 extends through the downhole components 116 and to the integrated igniter 105. The communication link 118 also extends through the release tool 103 to the setting tool 116*e* and/or the plug assembly 116*f*. The surface unit 108 may be provided with personnel (e.g., operators) and/or electronics (e.g., central processing units (CPUs), controllers, etc.) for sending trigger signals via the communication link 118 to the integrated igniter 105.

While FIG. 1 shows a certain configuration of the wellsite 100, the surface equipment 102*a*, and the downhole equipment 102*b*, various configurations may be used. For example, one or more communication links 118, surface units 108, and/or other devices may be provided for triggering the integrated igniter 105 and activating the release tool 103. In another example, the downhole tool 101 may have one or more downhole components 116 in use with one or more release tools 103 and/or integrated igniters 105. Additionally, while not shown, it will be appreciated that the release tool 103 could also be coupled to other downhole components 116 and/or portions of the downhole tool 101 for release into the wellbore 104 (FIG. 1). It will also be appreciated that, while the descriptions herein refer to certain uphole and downhole positions, such positions may optionally be reversed.

Figure 2A:
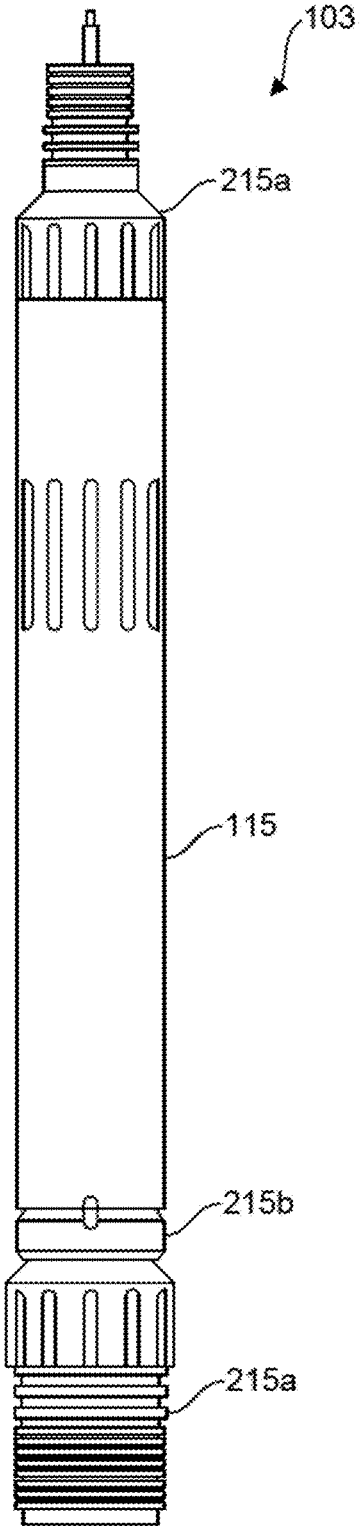
FIGS. 2A and 2B show side and cross-sectional views, respectively, of the release tool.
Figure 2B:
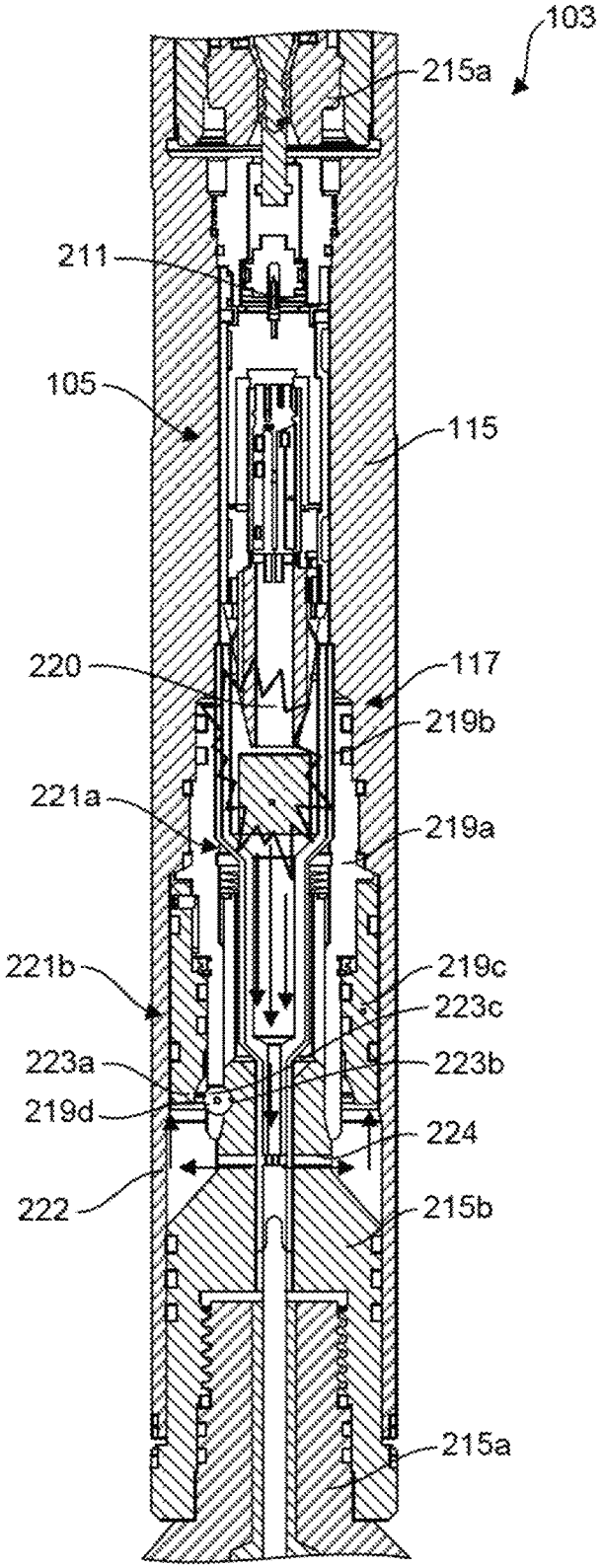
Figure 3A:
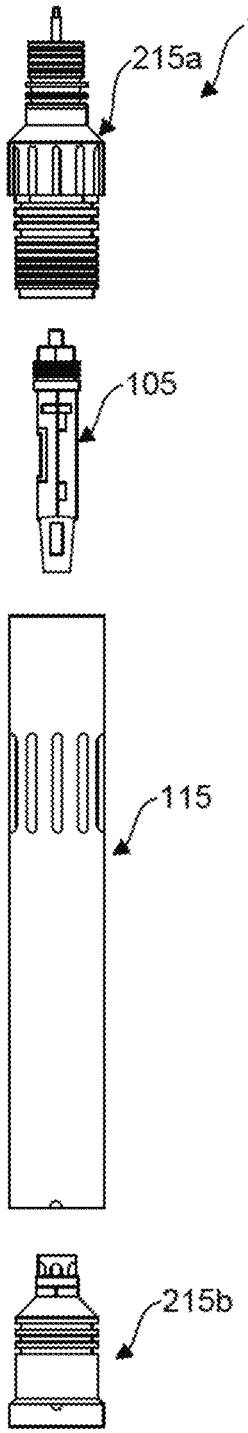
FIGS. 3A and 3B show exploded views of the release tool.
Figure 3B:
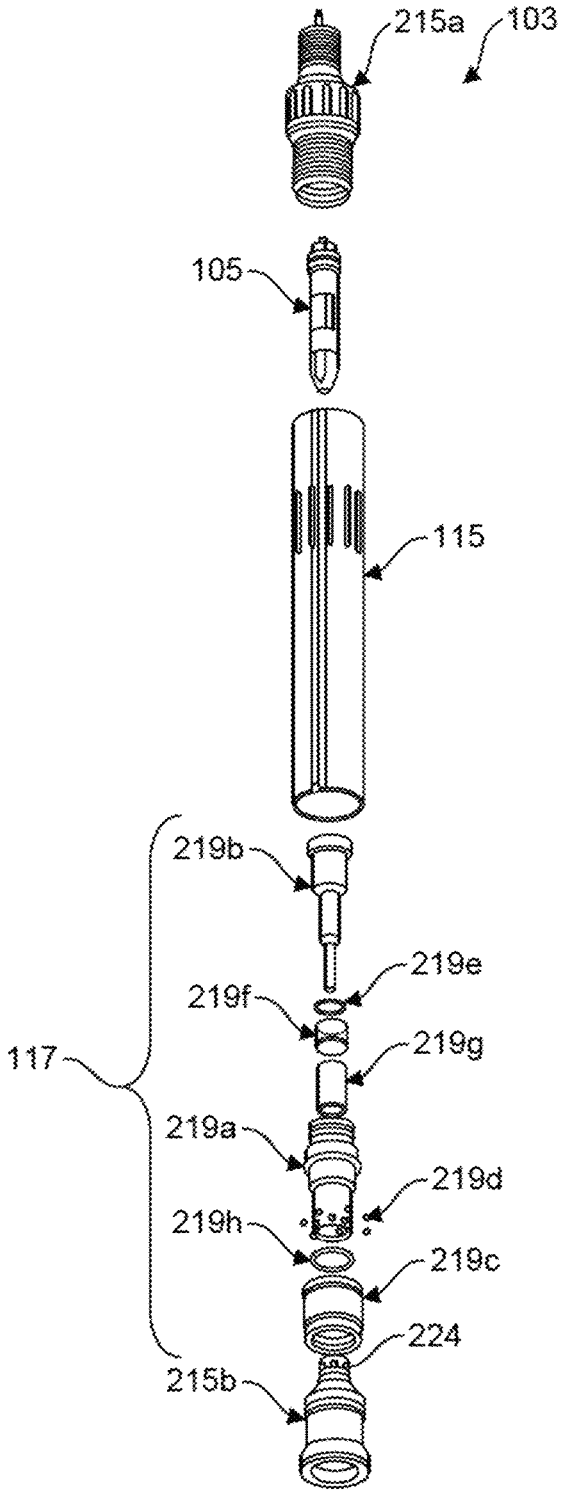

FIGS. 2A-2B and 3A-3B show various views of the release tool 103. FIGS. 2A and 2B show side and cross-sectional views, respectively, of the release tool 103. FIGS. 3A and 3B show exploded views of the release tool 103. These figures show example configurations of the release tool 103 with the integrated igniter 105. As shown in these figures, the integrated igniter 105 is integrated into the release tool 103 for ballistic activation of the release tool 103 to perform a release operation. This configuration may be used to provide a unitary release tool 103 capable of releasing the downhole portion 101*b* of the downhole tool 101, such as the setting tool 116*e* and the plug assembly 116*f* (and/or other downhole component(s) 116) (FIG. 1).

As also shown in FIG. 2A-3B, the release tool 103 includes the release housing 115, the release assembly 117, and the integrated igniter 105. The release housing 115 is a tubular metal member with a passage 211 therethrough. In the example shown, a top sub 215*a* is positioned in an uphole end of the release housing 115 and a bottom sub 215*b* is positioned in a downhole end of the release housing 115.

The top sub 215*a* may extend into and threadedly connect to an uphole end of the release housing 115. The bottom sub 215*b* may extend into a downhole end of the release housing 115. The top and bottom subs 215*a,b* may also connect to an adjacent downhole component 116, such as the perforating tool 116*d* and the setting tool 116*e* (FIG. 1), respectively. In the example shown in FIGS. 2A and 2B, the bottom sub 215*b* is connected to another top sub 215*a* of an adjacent downhole component 116. The top and bottom subs 215*a,b* may be electrical connectors and/or support electrical components capable of passing signals to the adjacent downhole components 116 as described further herein.

The release assembly 117 and the integrated igniter 105 are positioned in the release housing 115 between the top sub 215*a* and the bottom sub 215*b*. The release assembly 117 is positioned between the integrated igniter 105 and the bottom sub 215*b*. The release assembly 117 includes a release mandrel 219*a*, a feedthru 219*b*, a locking sleeve 219*c*, and locking balls 219*d*. The release mandrel 219*a* has an uphole end shaped for connection within the release housing 115 and a downhole end shaped for receivingly connecting to the bottom sub 215*b*.

The release mandrel 219*a* is a tubular member positionable in the release housing 115 to support an electrical coupling 221*a* and a locking mechanism 221*b* therein. The electrical coupling 221*a* is provided by the feedthru 219*b*. The feedthru 219*b* is an elongate member with a stepped outer surface that extends into an uphole end of the release mandrel 219*a*. The feedthru 219*b* may be an electrical contact shaped for electrical contact with the integrated igniter 105 at one end and the bottom sub 215*b* at an opposite end.

A retainer spring 219*e*, a disk spring 219*f*, and a ball catch 219*g* may be positioned between the feedthru 219*b* and the release mandrel 219*a* to support the feedthru 219*b* in the release mandrel 219*a*. The ball catch 219*g* may be a tubular member slidably positioned within the uphole end of the release mandrel 219*a* and may be shaped to receive and support the feedthru 219*b* therein. The retainer spring 219*e* may be a ring-shaped spring positioned between the feedthru 219*b* and the release mandrel 219*a* to cushion the feedthru 219*b* about the release mandrel 219*a*. The disk spring 219*f* may be a wave-shaped spring positioned between the feedthru 219*b* and the release mandrel 219*a* to retain the ball catch 219*g* about the release mandrel 219*a*.

In the example shown in FIGS. 2B and 3B, the locking mechanism 221*b* includes the locking sleeve 219*c* and the locking balls 219*d*. The locking sleeve 219*c* and the locking balls 219*d* are movable members movably positioned between a downhole end of the release mandrel 219*a* and the release housing 115. The locking sleeve 219*c* is a tubular member slidably movable along an outer periphery of the release mandrel 219*a* and along an inner surface of the release housing 115. The locking sleeve 219*c* has a tapered downhole end that defines an angled ball surface 223*a*. The ball surface 223*a* is angled away from the downhole end of the release mandrel 219*a*. A disk spring 219*h* may be positioned between the locking sleeve 219*c* and the release mandrel 219*a* to cushion movement of the locking sleeve 219*c*.

The locking balls 219*d* are movably positionable about the locking sleeve 219*c*, the release mandrel 219*a*, and the bottom sub 215*b* in response to movement of the locking sleeve 219*c*. Seven locking balls 219*d* are shown, but any number may be provided. The release mandrel 219*a* has ball receptacles (holes) 223*c* radially disposed about a downhole end of the release mandrel 219*a*. The bottom sub 215*b* has ball seats (depressions) 223*b* shaped to receive the locking balls 219*d*. In a locked position, the locking balls 219*d* are seated in the ball seats 223*b*, extend through the ball receptacles 223*c*, and contact the locking sleeve 219*c*. Upon the uphole movement of the locking sleeve 219*c*, the locking balls 219*d* move radially away from the ball seats 223*b*, through the ball receptacles 223*c*, and against the ball surface 223*a* of the locking sleeve 219*c*. In the unlocked position, the locking balls 219*d* are no longer wedged into the ball seats 223*b*, thereby freeing the bottom sub 215*b* as is described further herein.

The integrated igniter 105 is receivably positioned in the release housing 115 between the release assembly 117 and the top sub 215*a*. The integrated igniter 105 is electrically connected to the top sub 215*a*. The top sub 215*a* is electrically connected to the other downhole components 116*a-d* and the conveyance 110, thereby forming part of the communication link 118 (FIG. 1). An electrical pathway may be defined by the communication link 118 for sending a trigger signal from the surface unit 108, through the downhole components 116*a-d*, to the top sub 215*a*, and to the integrated igniter 105. The integrated igniter 105 is electrically connected to the electrical coupling 221*a* (and/or the feedthru 219*b*) which is connected to the bottom sub 215*b*, thereby extending the communication link 118 through the release tool 103 and to the other downhole components 116*e,f*. Examples of igniters that may be used as the integrated igniter 105 are described further herein.

The integrated igniter 105 is activatable by the trigger signal to ignite a propellant 220, thereby releasing pressurized fluid (e.g., gas) through the ball catch 219*g* and into a pressure chamber 222 defined between the bottom sub 215*b* and the locking sleeve 219*c*. The release mandrel 219*a* may have holes 224 about an uphole end of the bottom sub 215*b* for passing fluid from the ball catch 219*g* through the holes 224 and into the pressure chamber 222. This fluid has a pressure used to activate the release assembly 117 to shift the locking mechanism 221*b* (e.g., the locking sleeve 219*c* and the locking balls 219*d*) from the locked to the unlocked position as is described further herein.

While specific configurations of the release tool 103 and the integrated igniter 105 integrated therewith are shown, it will be appreciated that various configurations of the integrated igniter 105 and the release tool 103 may be provided. For example, one or more components of the release tool 103 and/or the integrated igniter 105 and various shapes of components can be provided.

Figure 4A:
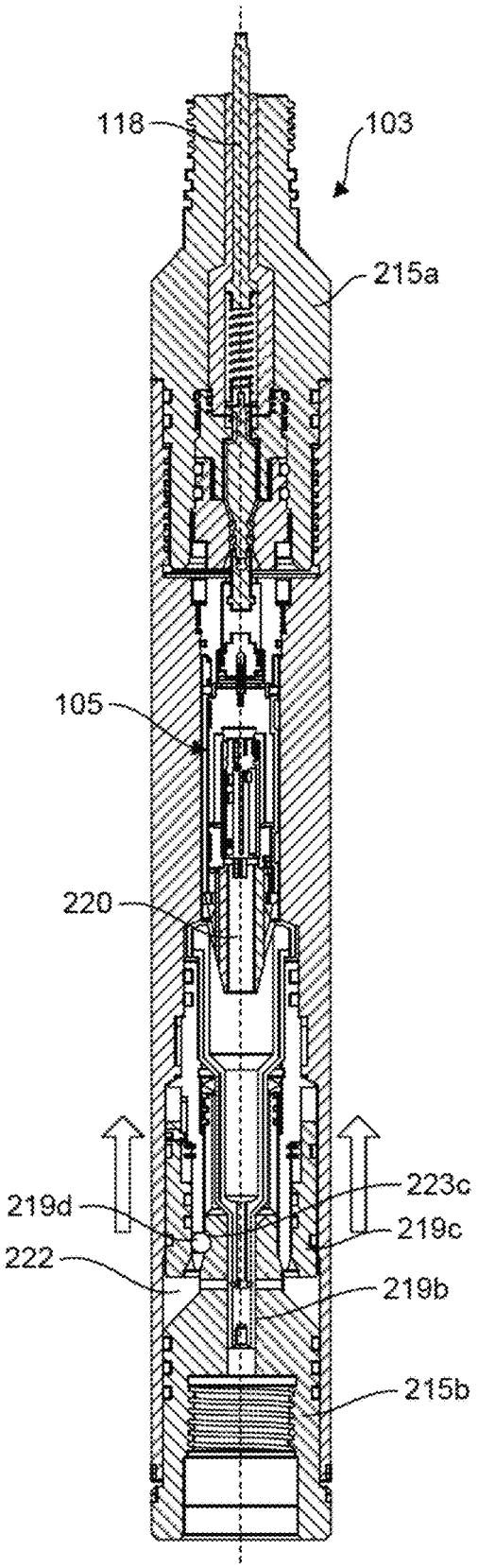
FIGS. 4A and 4B are cross-sectional views of the release tool before and after activation by the integrated igniter.
Figure 6A:
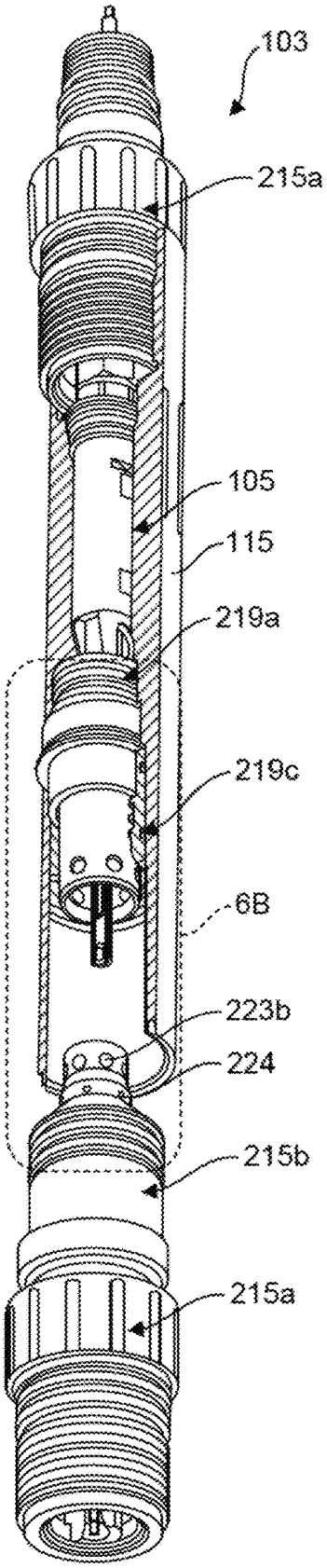
FIGS. 6A and 6B are partial, cross-sectional views of the release tool with the locking sleeve in an unlocked position.
Figure 6B:
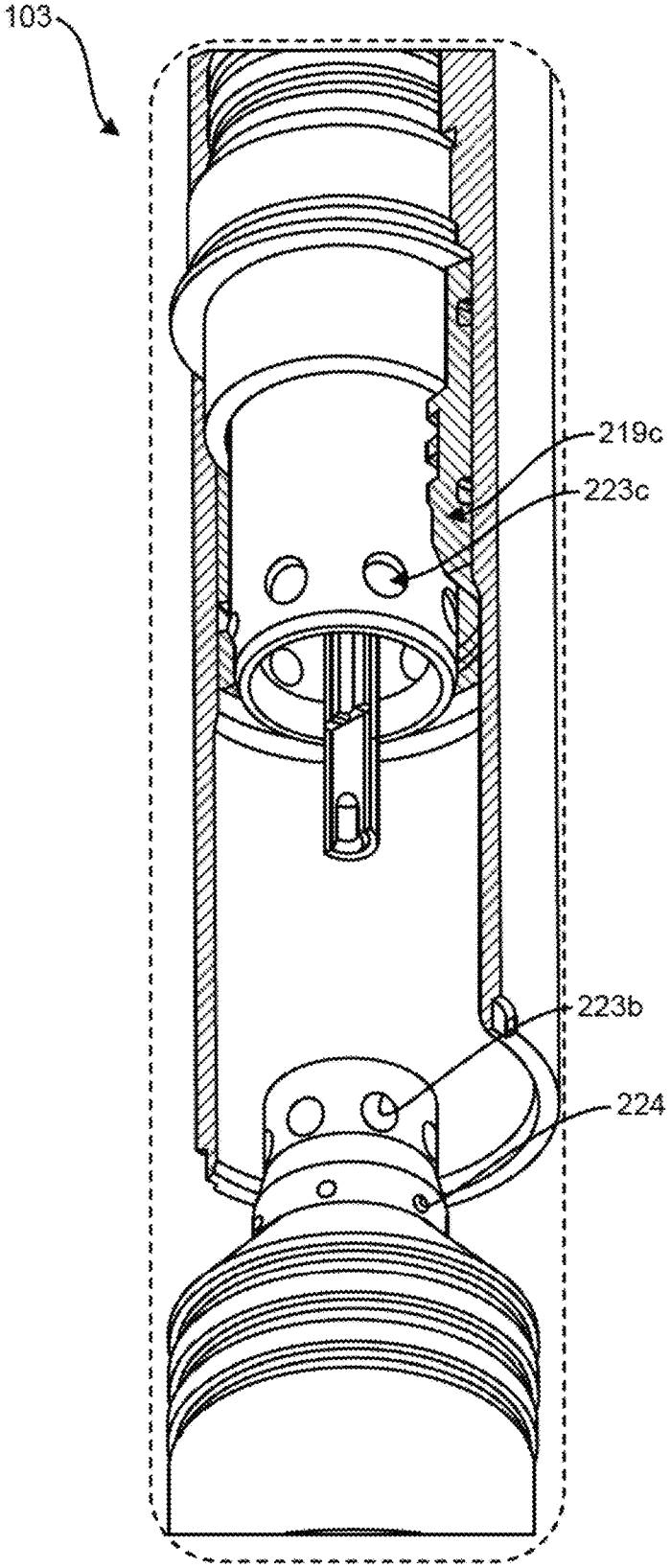

FIGS. 4A-6B show various views of activation of the release tool 103. FIGS. 4A and 4B are cross-sectional views of the release tool 103 before and after activation by the integrated igniter 105. FIGS. 5A and 5B are partial, cross-sectional views of the release tool 103 with the locking sleeve 219*c* in the locked position. FIG. 5B is a detailed view of a portion 5B of FIG. 5A. FIGS. 6A and 6B are partial, cross-sectional views of the release tool 103 with the locking sleeve 219*c* in the locked position. FIG. 6B is a detailed view of a portion 6B of FIG. 6A. As shown by these views, the integrated igniter 105 may be triggered to activate the release tool 103 to release the downhole portion 101*b* of the downhole tool 101 (FIG. 1).

As shown by FIGS. 4A-6B, the trigger signal is an electrical current passed via the communication link 118 through the top sub 215*a* and to the integrated igniter 105. The integrated igniter 105 is triggered by the trigger signal to ignite the propellant 220 and release a pressurized fluid through the feedthru 219*b* and into the pressure chamber 222 as shown in FIG. 4A. The pressurized gas applies a force against the locking sleeve 219*c* and drives the locking sleeve 219*c* from the locked position of FIGS. 4A, 5A, and 5B to the unlocked position of FIGS. 4B, 6A, and 6B.

Figure 4B:
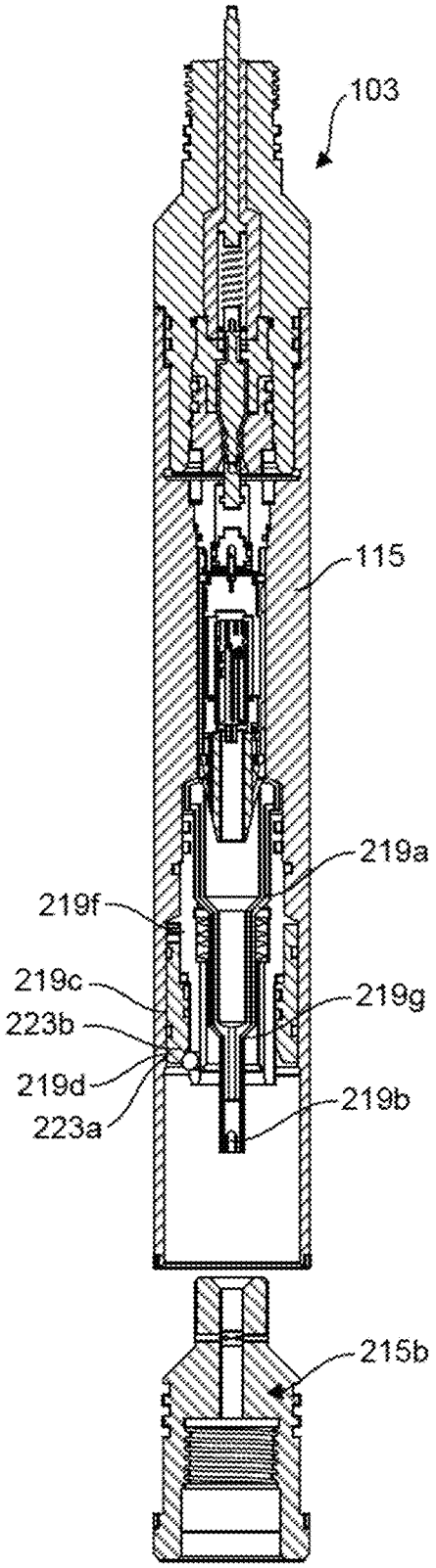
Figure 5A:
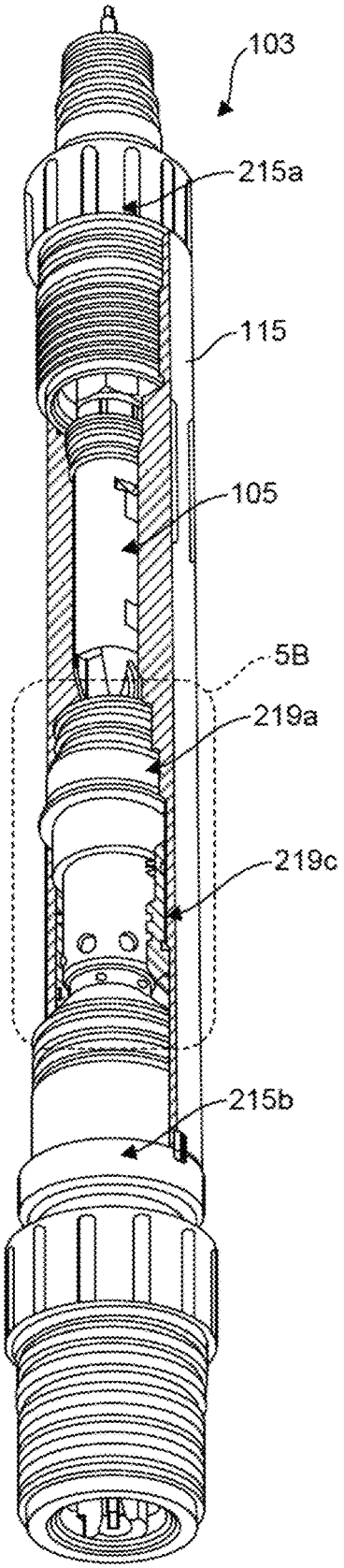
FIGS. 5A and 5B are partial, cross-sectional views of the release tool with a locking sleeve in a locked position.
Figure 5B:
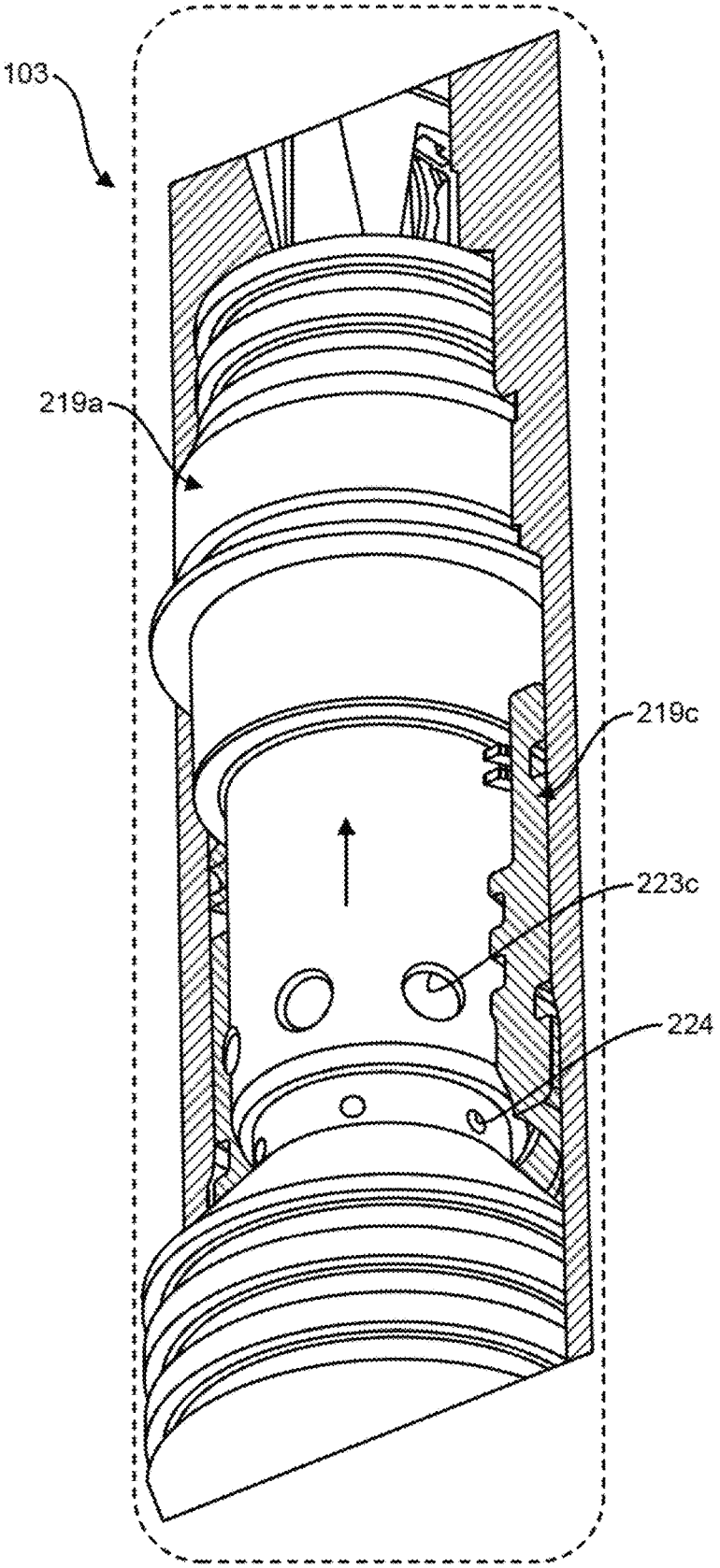

As shown in FIGS. 4B, after the locking sleeve 219*c* moves to the unlocked position, the locking balls 219*d* move from the locked (seated) position in the ball seats 223*b* of the release mandrel 219*a* to the unlocked (unseated) position against the ball surface 223*a* of the locking sleeve 219*c*. In this unlocked position, the locking balls 219*d* are no longer seated in the ball seats 223*b* of the bottom sub 215*b*.

As shown in FIGS. 4B, 6A, and 6B, with the locking balls 219*d* unseated, an uphole end of the bottom sub 215*b* is free to slidingly move out of the release mandrel 219*a* and the release housing 115. The ball catch 219*g* slidingly moves downhole with the bottom sub 215*b* and then retracts by force of the disk spring 219*f* as the bottom sub 215*b* releases from the release housing 115. The bottom sub 215*b* is now detached from the rest of the release tool 103. The bottom sub 215*b* and the downhole portion 101*b* attached to the bottom sub 215*b* are also free to fall away from the uphole portion 101*a* (FIG. 1). The uphole portion 101*a* my retrievable to the surface by the conveyance 110 (FIG. 1). With the downhole portion 101*b* detached, the uphole portion 101*a* may be more easily retrieved, particularly if the downhole portion 101*b* is stuck in the wellbore 104 (FIG. 1).

Figure 7A:
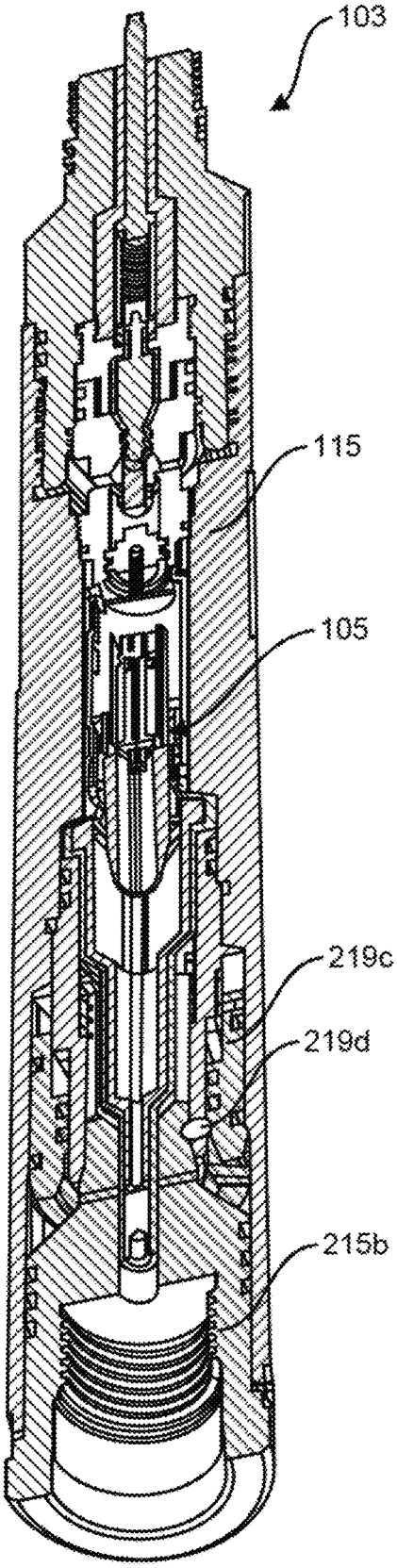
FIGS. 7A-7D are cross-sectional views showing an activation sequence of the release tool.
Figure 7B:
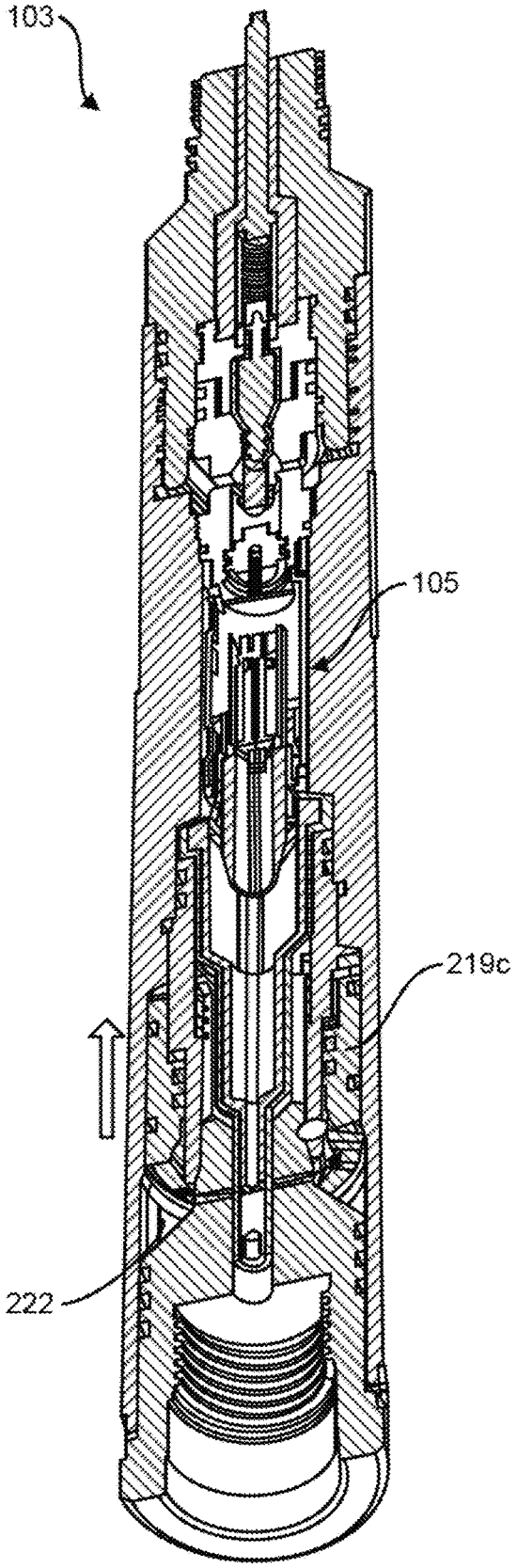
Figure 7C:
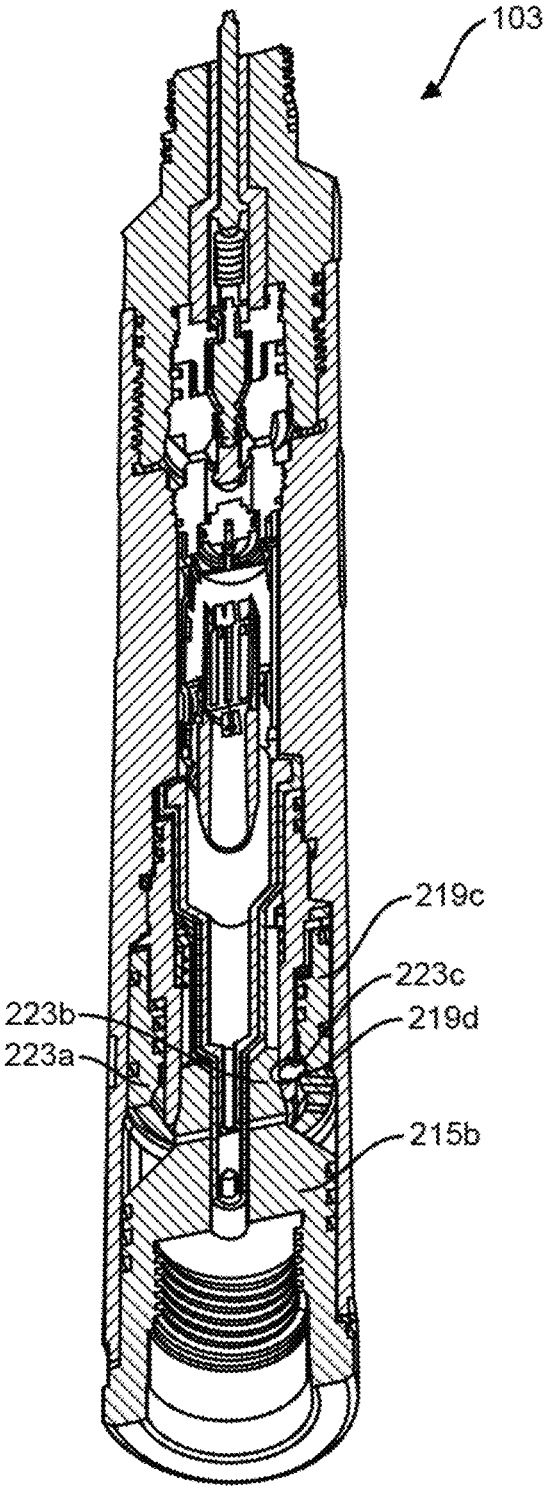

FIGS. 7A-7C are cross-sectional views showing an activation sequence of the release tool 103. FIG. 7A shows the release tool 103 in a pre-activation position with the integrated igniter 105 positioned therein before triggering. The locking sleeve 219*c* remains in its downward and locked position, and the bottom sub 215*b* is locked within the release housing 115 by the locking balls 219*d*.

FIG. 7B shows the release tool 103 after a trigger signal is sent from the surface to the integrated igniter 105 and the integrated igniter 105 is triggered to ignite the propellant 220 (FIG. 2B) and pressure is released into the chamber 222. This pressure has driven the locking sleeve 219*c* uphole to the unlocked position as indicated by the upward arrow.

FIG. 7C shows the movement of the locking balls 219*d* after the locking sleeve 219*c* has shifted to the unlocked position. This movement of the locking sleeve 219*c* has allowed the locking balls 219*d* to move radially from the ball seats 223*b* of the bottom sub 215*b* through the ball receptacles 223*c* and against the ball surface 223*a* of the locking sleeve 219*c*.

Figure 7D:
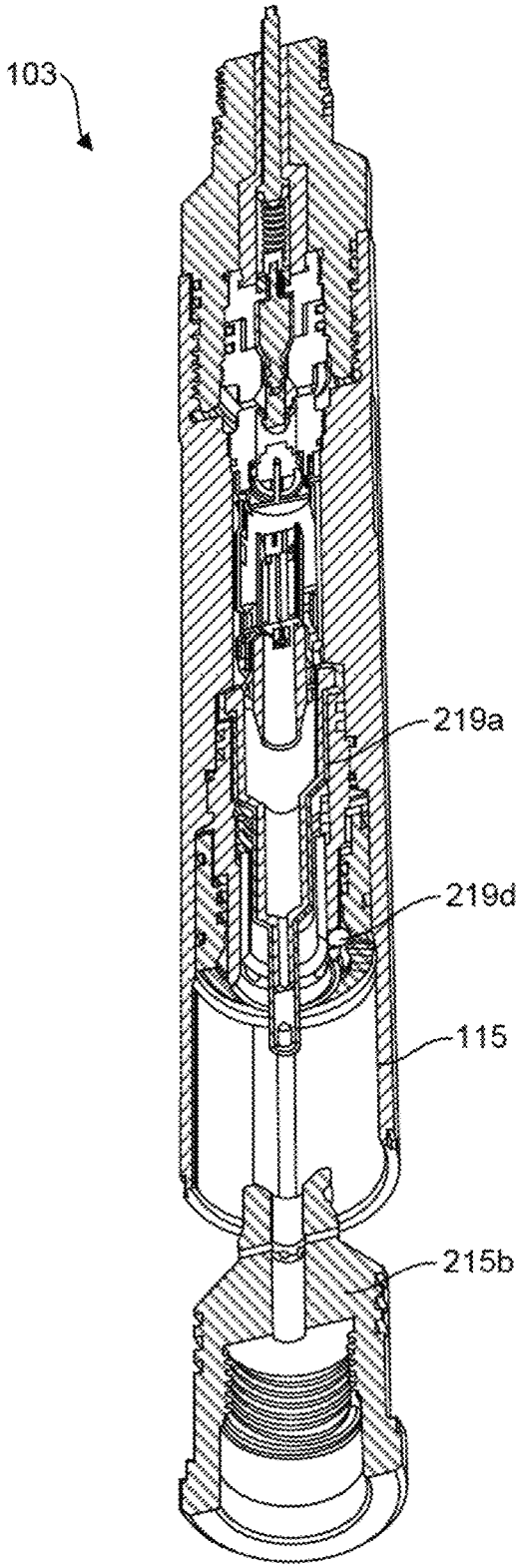

FIG. 7D shows detachment of the bottom sub 215*b* after movement of the locking balls 219*d* to the unlocked position. The bottom sub 215*b* is no longer retained by the locking balls 219*d* and is now free to move away from the release mandrel 219*a* and to slide out of the release housing 115. Once the bottom sub 215*b* has detached, the downhole portion 101*b* connected to the bottom sub 215*b* may be released from the uphole portion 101*a* of the downhole tool 101 (FIG. 1).

Figure 7E:
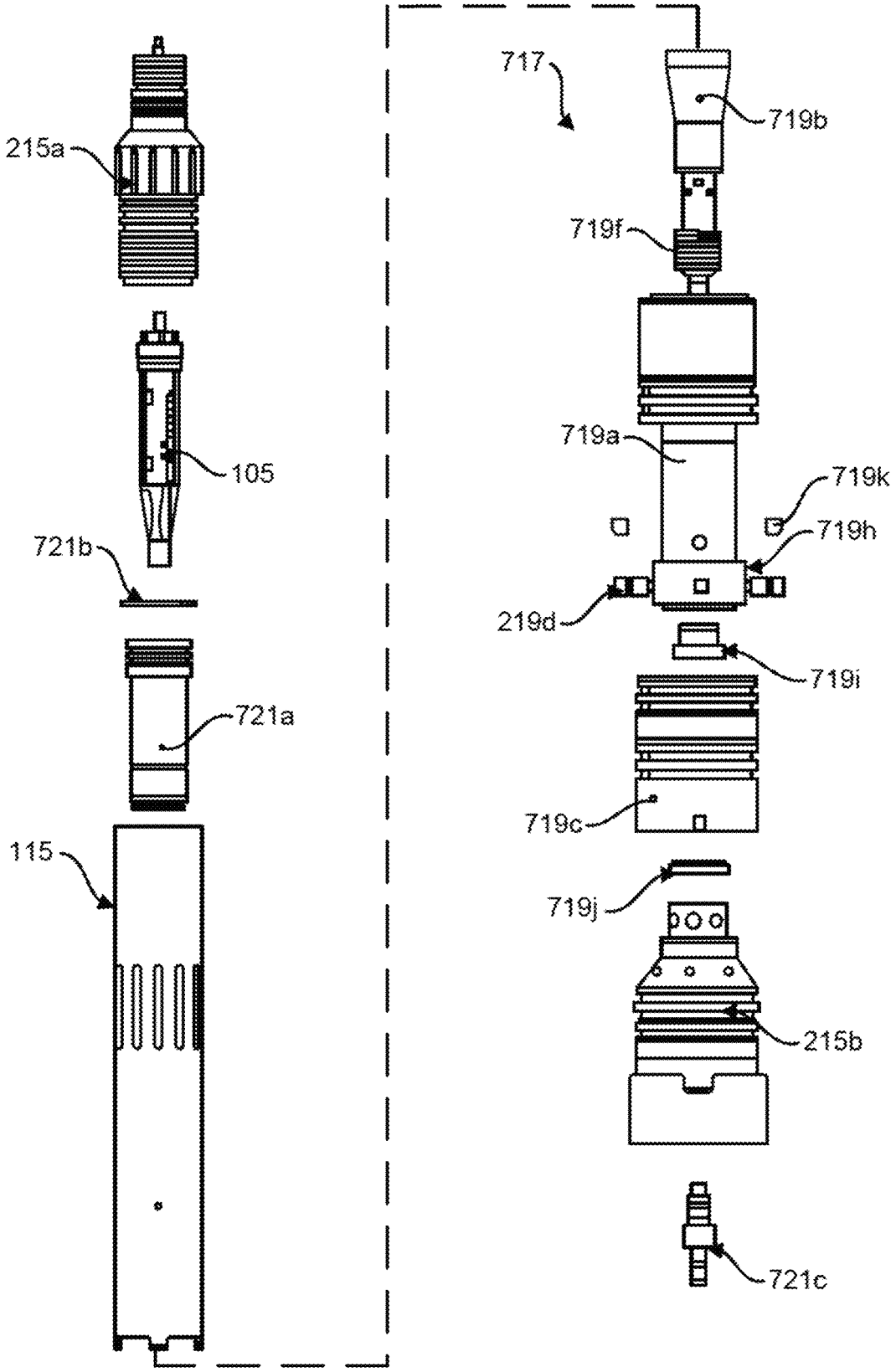
FIGS. 7E and 7F are exploded and cross-sectional views, respectively, of another version of the release tool.
Figure 7F:
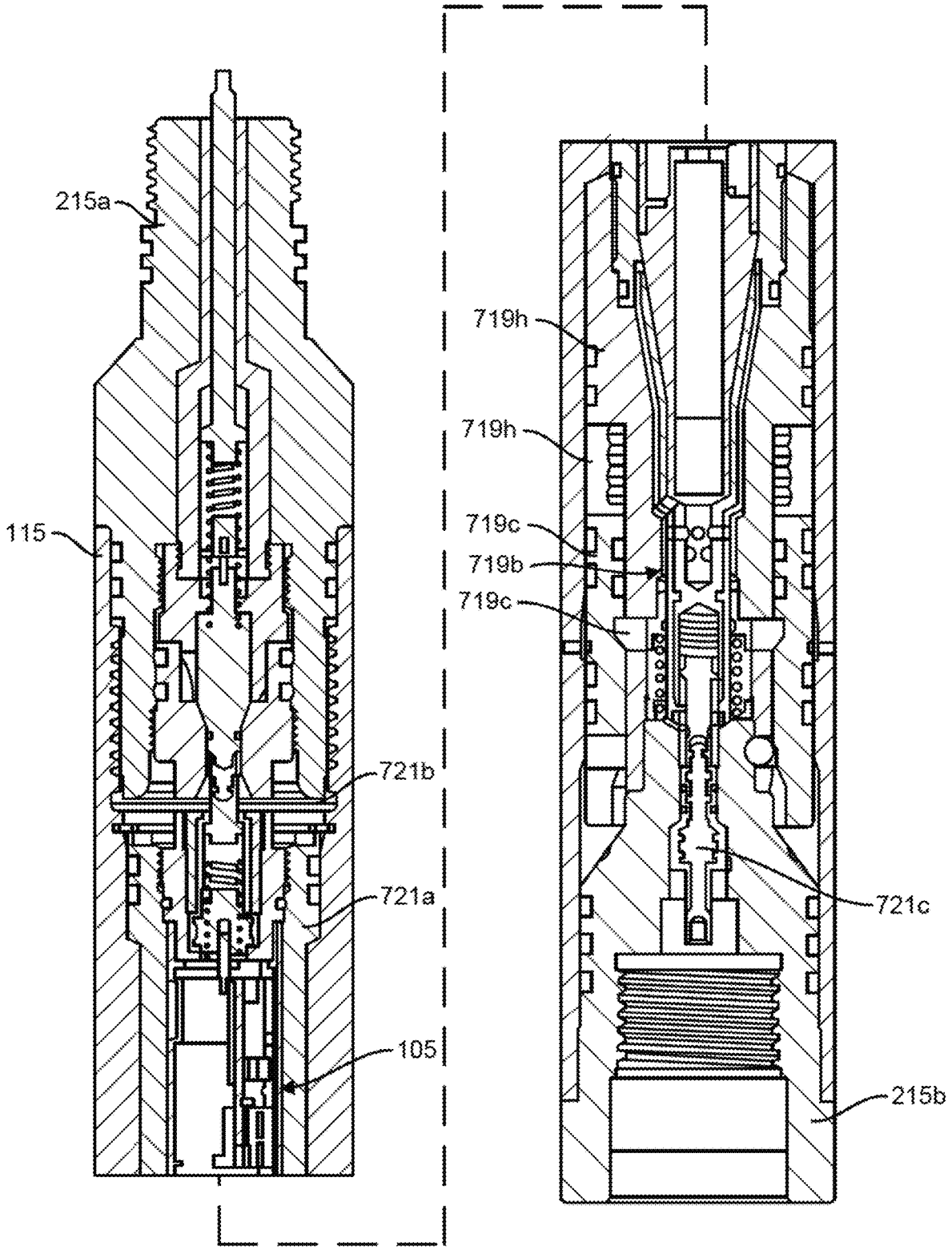

FIGS. 7E and 7F are exploded and cross-sectional views, respectively, of another version of the release tool 703. As shown in these views, the release tool 703 may be provided with various components to facilitate operation. As shown in FIG. 7E, the release tool 703 includes the top sub 215*a*, the bottom sub 215*b* and the release housing 115 as described herein for the release tool 103 (see, e.g., FIGS. 3A and 3B). In this version, the release tool 703 also includes a release housing nut 721*a*, a retainer ring 721*b*, a sub feedthru 721*c*, and a different release assembly 717. The release housing nut 721*a* may be a tubular member concentrically positioned between the release housing 115 and the ignitor 105. The release housing nut may be provided to receivingly support the ignitor 105 therein and define a chamber for passing fluid (e.g., gas) from the ignitor 105 when ignited. The retainer ring 721*b* may be a circular member positioned about an end of the release housing nut 721 and the top sub 215*a*. The sub feedthru 721*c* may be an electrical connector positionable in the bottom sub 215*a* and electrically connectable to portions of the release tool 703 and an adjacent downhole component connected to the bottom sub 215*b* for passing signals therebetween.

The release assembly 717 includes a release mandrel (housing) 719*a*, a feedthru 719*b*, a locking (release) sleeve 719*c*, and locking balls 219*d*. The locking balls 219*d* may be the same as those described herein. The release mandrel 719*a*, feedthru 719*b*, and locking sleeve 719*c* may be similar to the release mandrel 219*a*, feedthru 219*b*, and locking sleeve 219*c* as described herein, except with different shapes. Springs 719*f* and 719*h* may be similar to springs 219*f* and 219*h* as described herein, except with different shapes.

The release assembly 717 also includes a sleeve 719*i*, a cap 719*j*, and pins 719*k*. The sleeve 719*i* may be shaped to support the feedthru 719*b* about the internal end of the bottom sub 215*b*. The cap 719*j* may be secured about an internal end of the bottom sub 215*b*. The pins 719*k* may be retaining pins for securing the release mandrel 719*a* within the release tool 703.

In operation, the release assembly 717 performs the same functions as the release assembly 117 described herein. In this case, with the release assembly 717, electrical current is passed through the top sub 215*a* to trigger the switch assembly of the ignitor to ignitor the propellant. The propellant releases a pressurized gas into the release tool 103. This pressure is passed through the holes in the insulated feedthru 719*b*. This causes the small internal piston 7191 to shift. After the small piston has shifted, the retainer pins 719*k* move inward allowing the sleeve 719*i* to shift. This allows the ball bearings 219*d* to move freely and shift, thereby allowing the fishing neck to release from the release assembly 717. This unlocks the release assembly 717 and allows the downhole portion 101*b* to release from the uphole portion 101*a*.

Figure 8A:
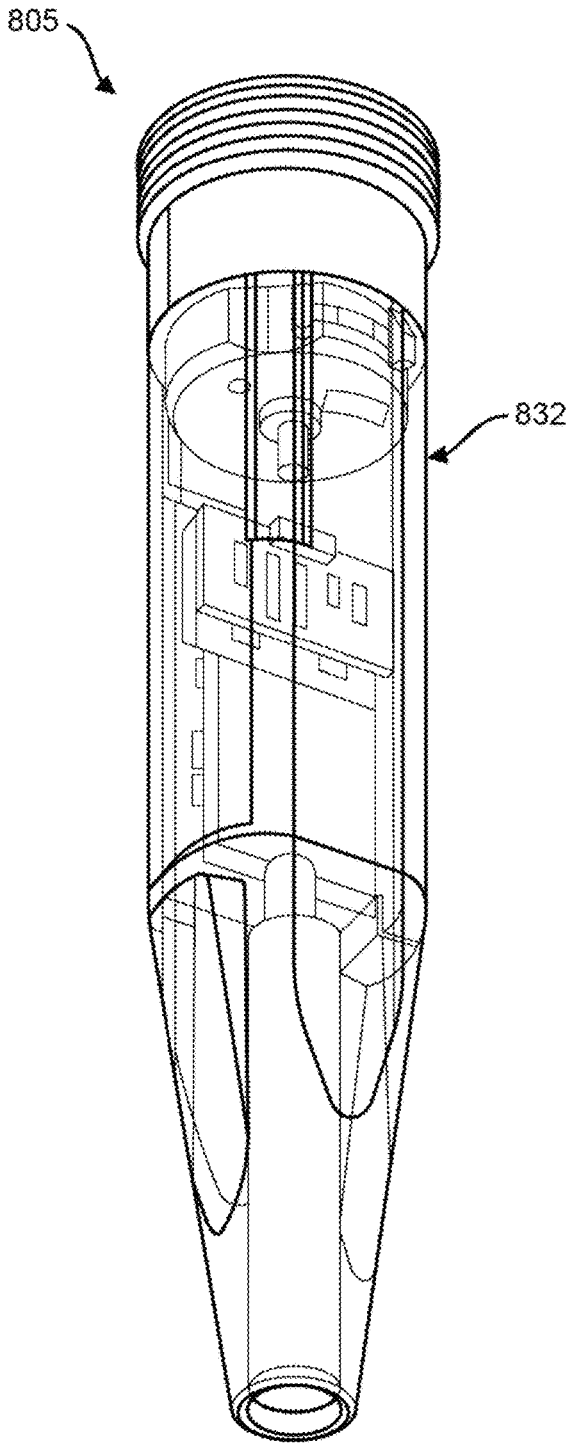
FIGS. 8A-8C are hidden, partial cross-sectional, and exploded views, respectively, of the integrated igniter with a single switch assembly.

FIGS. 8A-10C show various versions of the igniter 805, 905, and 1005. Any of these versions of the igniter 805, 905, 1005 may be used as the integrated igniter 105 as described herein. FIGS. 8A-8C show a single contact version of the igniter 805, and FIGS. 9A-9C show a dual contact version of the igniter 905. These versions have the propellant 119 in an internal position. These versions also may not require a locking or screw or support about the propellant 119.

Figure 8B:
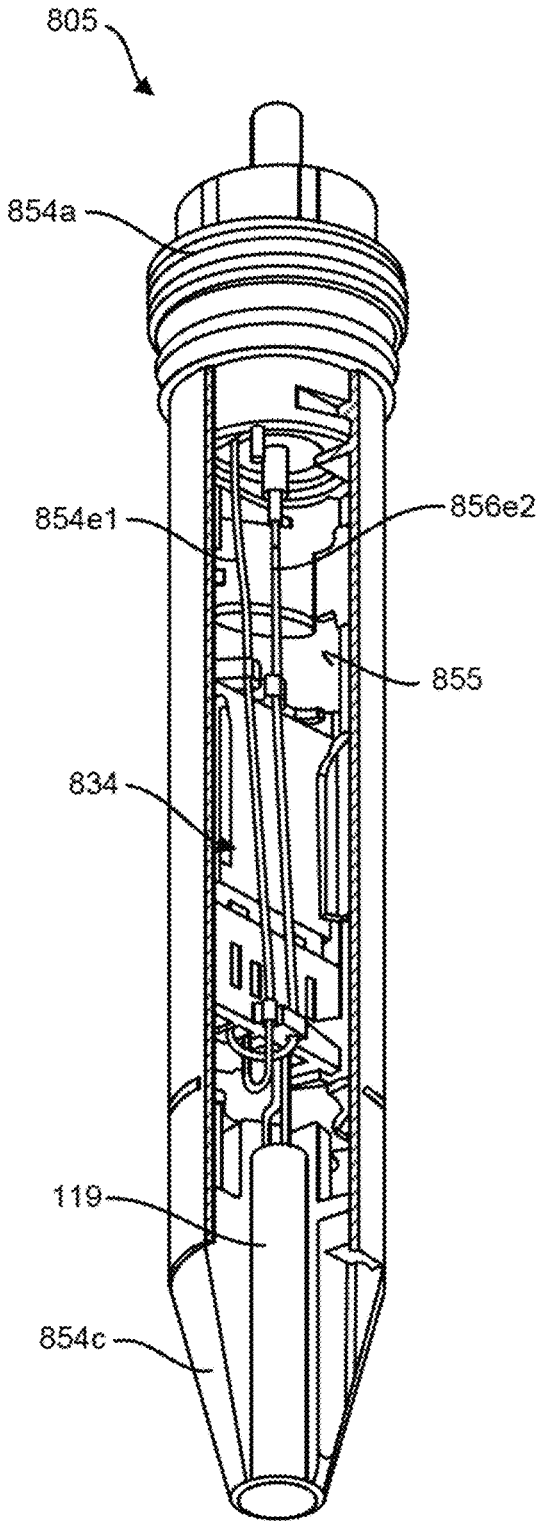
Figure 8C:
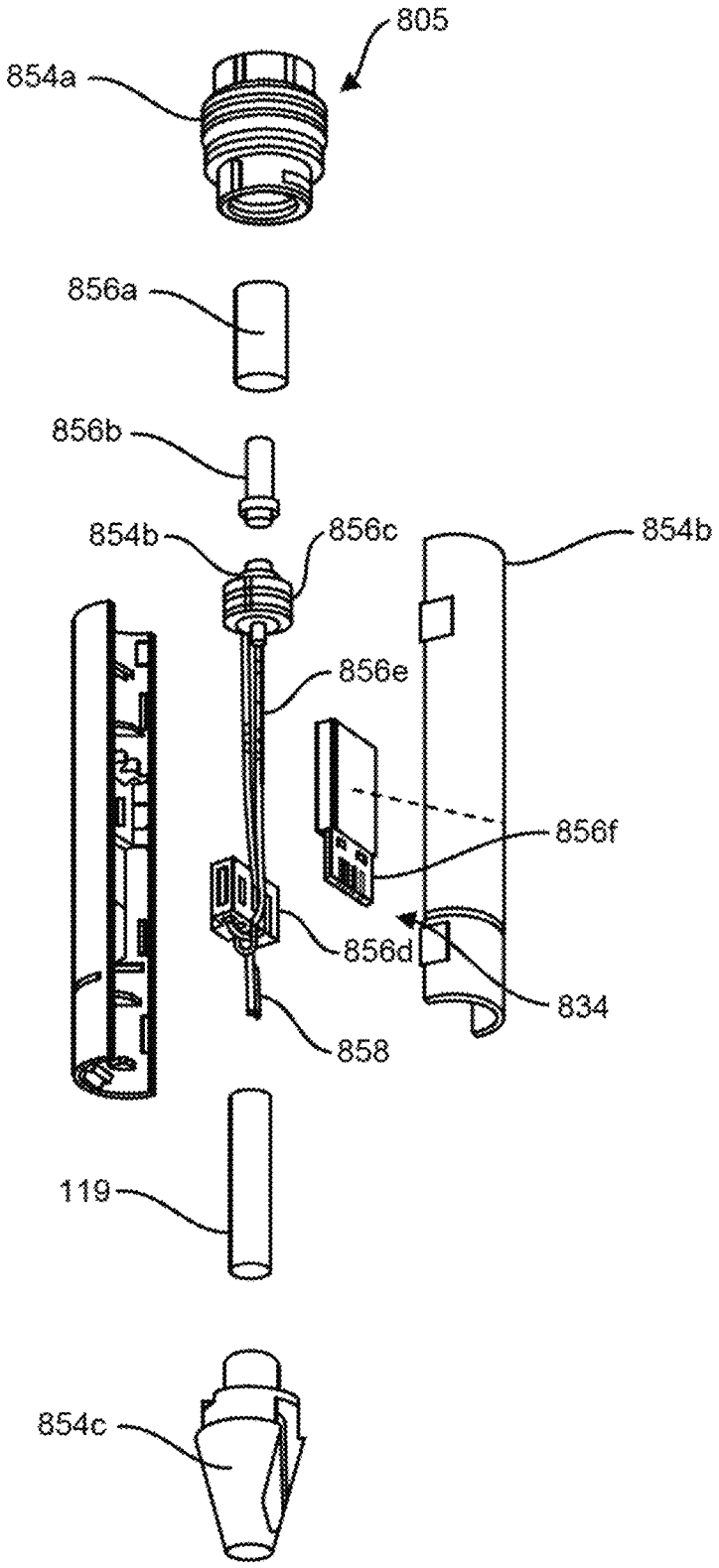

FIGS. 8A-8C are hidden, partial cross-sectional, and exploded views, respectively, of the igniter 805 with a single switch assembly 834. In this version, the igniter 805 includes an igniter housing 832, the switch assembly 834, and the propellant 119. The igniter housing 832 includes a bulkhead (or uphole connector) 854*a*, igniter portions 854*b*, and a nose cone 854*c*. The igniter housing 832 may be shaped for insertion into the release housing 115 of the release tool 103 (see, e.g., FIGS. 2B and 4A-4B).

The bulkhead 854*a* is a cylindrical member with threads thereon for threaded connection to the downhole component 116 (e.g., the perforating tool 116*d* of FIG. 1). The nose cone 854*c* is a tapered member with a passage for extension of the propellant 119 therethrough. The igniter portions 854*b* are curved portions that form a tubular member when joined together. The igniter portions 854*b* are attached to the bulkhead 854*a* at one end and the nose cone 854*c* at an opposite end to form a switch chamber 855 for receiving the switch assembly 834 therein. The nose cone 854*c* may be shaped for easy removal and for easy access to the propellant 119 to facilitate replacement of the propellant 119 after use or as needed, and/or to facilitate access into the igniter 805.

The switch assembly 834 is supported within the igniter housing 832. The switch assembly 834 includes an insulator 856*a*, a plunger 856*b*, a plunger plug 856*c*, a single igniter plug 856*d*, wires 856*e*, and a single addressable switch 856*f*. The insulator 856*a* is a tubular, spring-loaded member connected to the bulkhead 854*a*. The insulator 856*a* is made of a non-conductive material to prevent electrical contact between the bulkhead 854*a* and the switch assembly 834. The plunger 856*b* is positioned in the insulator 856*a* and extends therefrom for connection to the plunger plug 856*c*.

The plunger 856*b* may be an electrical connector for connecting the switch assembly 834 to other portions of the downhole tool 101 for communication therewith. For example, the plunger 856*b* may extend through the bulkhead 854*a* for electrical connection to the perforating tool 116*d* (FIG. 1), and/or to the communication link 118. The wires 856*e* may be electrically connected to other downhole components 116, the communication link 118, the conveyance 110, the surface unit 108, etc. (FIG. 1). In this manner, the switch assembly 834 may be electrically connected to the surface for receipt of a trigger signal.

The plunger plug 856*c* is an electrical connector supported in the igniter 805. The plunger plug 856*c* is electrically connectable to the plunger 856*b* at one end, and to the single igniter plug 856*d* by the wires 856*e* at the other end. The wires 856*e* may include a ground wire 856*e*1 and a surface link wire 856*e*2. The ground wire 856*e*1 may be coupled to the bulkhead 854*a*. The surface link wire 856*e*2 is electrically connected to the plunger 856*b*.

The single igniter plug 856*d* is an electrical connector supported in the igniter 805. The single igniter plug 856*d* is electrically connected to the addressable switch 856*f* by a plug contact 858*b*. In this version, the addressable switch 856*f* is a single switch and the plug contact 858 is a single contact. The single addressable switch 856*f* is electrically connected with the surface unit 108 via the single igniter plug 856*d*, the wires 856*e*, and the plunger 856*b* (which is in communication with the surface unit 108 as described herein).

The single addressable switch 856*f* is also electrically connected with the propellant 119 via the plug contact 858. The propellant 119 is also positioned within the igniter housing 832. The propellant 119 is shown as a tubular member supported within the nose cone 854*c* and extendable therethrough. The propellant 119 may include one or more individual power packs of combustible material ignitable by an electrical charge applied by the addressable switch 856*f*. The single addressable switch 856*f* may be used for a single ignition of the integrated igniter 805.

Figure 9A:
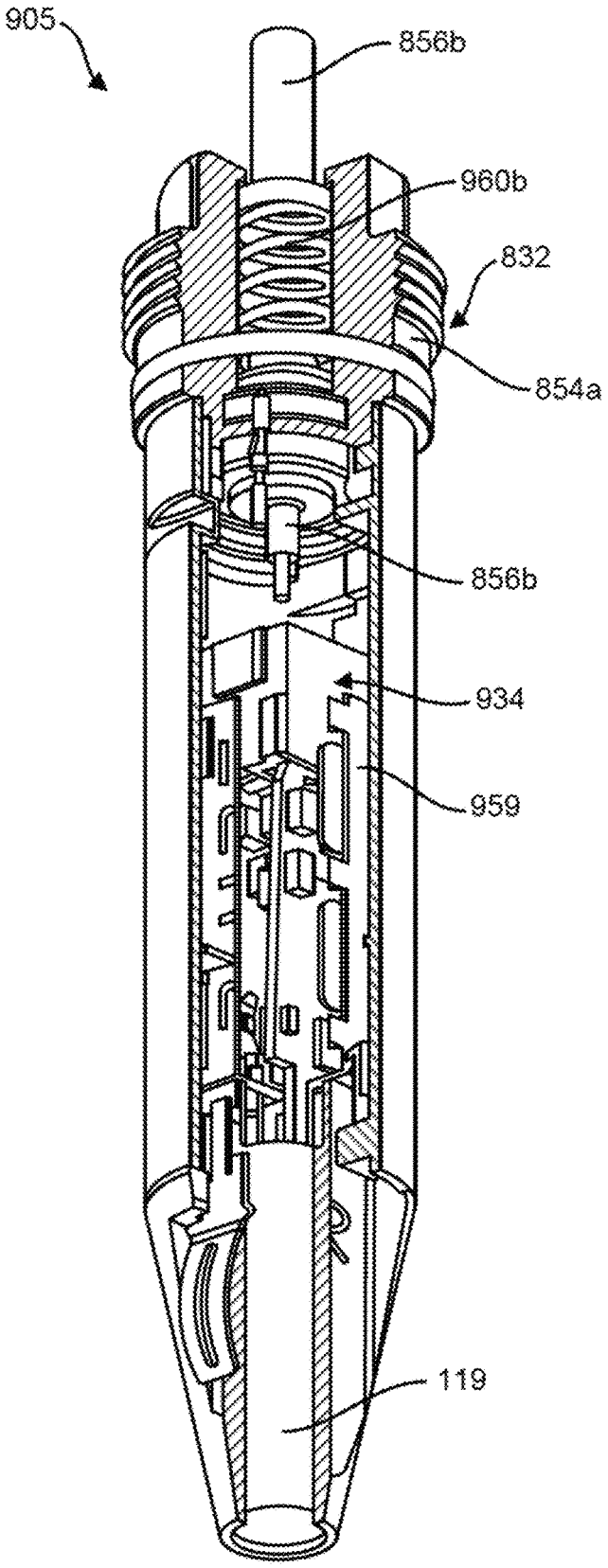
FIGS. 9A and 9B are partial cross-sectional and exploded views, respectively, of the integrated igniter with a dual switch assembly.
Figure 9B:
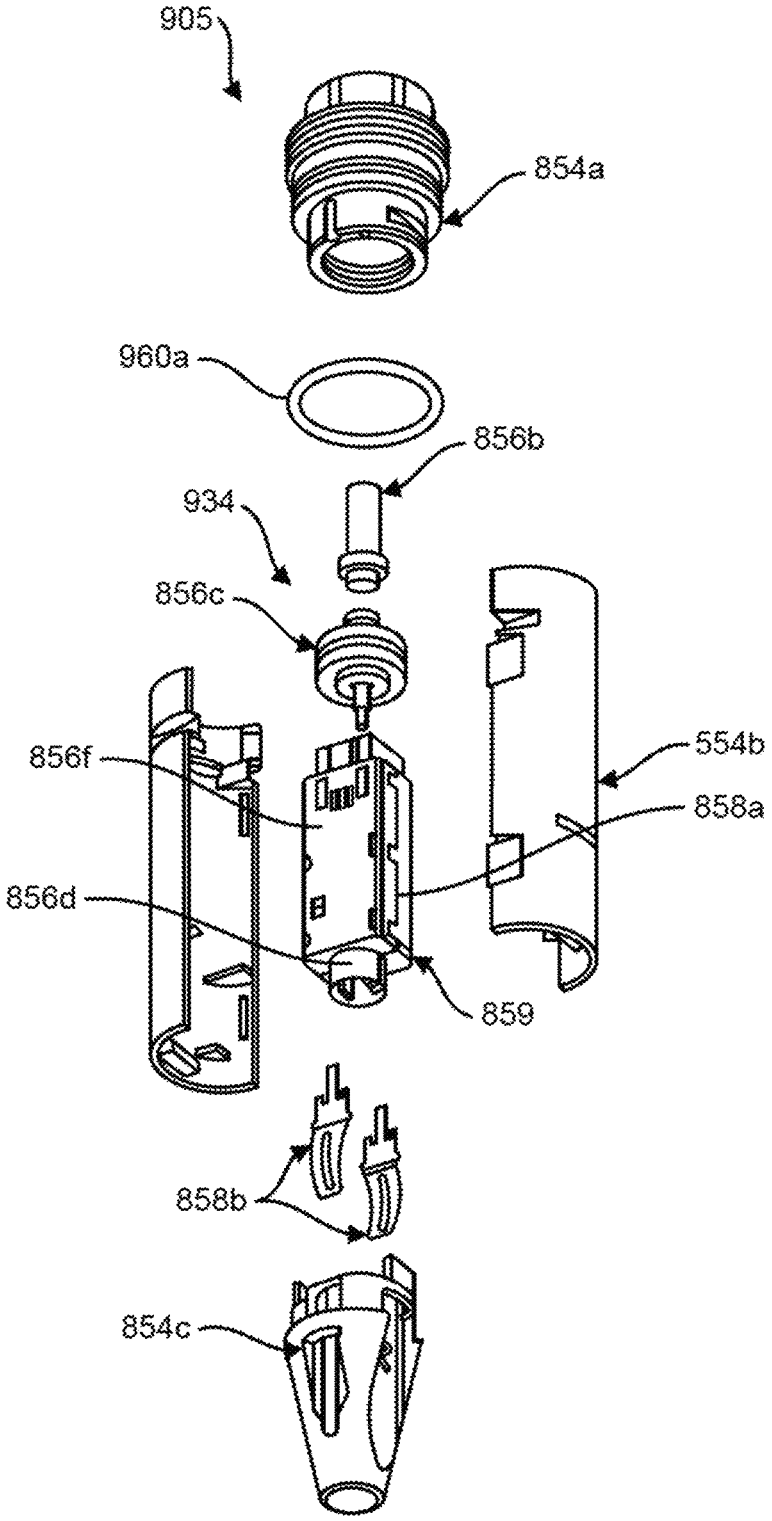

FIGS. 9A and 9B are partial cross-sectional and exploded views, respectively, of the igniter 905 with a dual switch assembly 934. This version is similar to the igniter 805 of FIGS. 8A-8C with the same igniter housing 832 (with bulkhead 854*a*, igniter portions 854*b*, and nose cone 854*c*), without an insulator 856*a*, and with a different switch assembly 934.

In this version, the dual switch assembly 934 includes the same plunger 856*b*, and wires 856*e* (as shown in FIGS. 8A-8C). This switch assembly 934 also includes a switch housing 859, an o-ring 860*a*, compression spring 860*b*, plunger plug 856*c*, a dual igniter plug 856*d*, and a dual addressable switch 856*f*. The plunger plug 856*c* includes a plunger plate 858*a* and dual plug contacts 858*b*. The o-ring 860*a* is positioned between the bulkhead 854*a* and the igniter portions 854*b*. The plunger 856*b* is supported in the bulkhead 854*a* by the compression spring 860*b*. The compression spring 860*b* is positioned within the bulkhead 854*a* between the plunger 856*b* and the plunger plug 856*c*.

The plunger plug 856*c* is an insulated feed thru supported in the igniter portions 854*b*. The switch housing 859, the plunger plug 856*c*, the dual igniter plug 856*d*, and the wires 858*e* may also supported in the igniter portions 854*b*. This switch housing 859 may enclose and/or support one or more components of the switch assembly 934 (e.g., plugs 854*c,d* and wires 856*e*) for easy removal and replacement after use or as needed.

The plunger plug 856*c* electrically connects the plunger 856*b* to the dual igniter plug 856*d*. The dual igniter plug 856*d* is electrically connected to the dual plug contact 858*b* and to the dual addressable switch 856*f*. The dual addressable switch 856*f* is connected to the propellant 119 by the dual plug contacts 858*b*. The addressable switch 856*f* has dual contacts 858*b* for redundant contact with the propellant 119. The dual addressable switch 856*f* may be used for a dual ignition of the integrated igniter 805. As demonstrated by this example, one or more contacts 858*b*, 858*b* may be used to provide redundant electrical connection with the propellant 119 to further assure ignition.

Figure 10A:
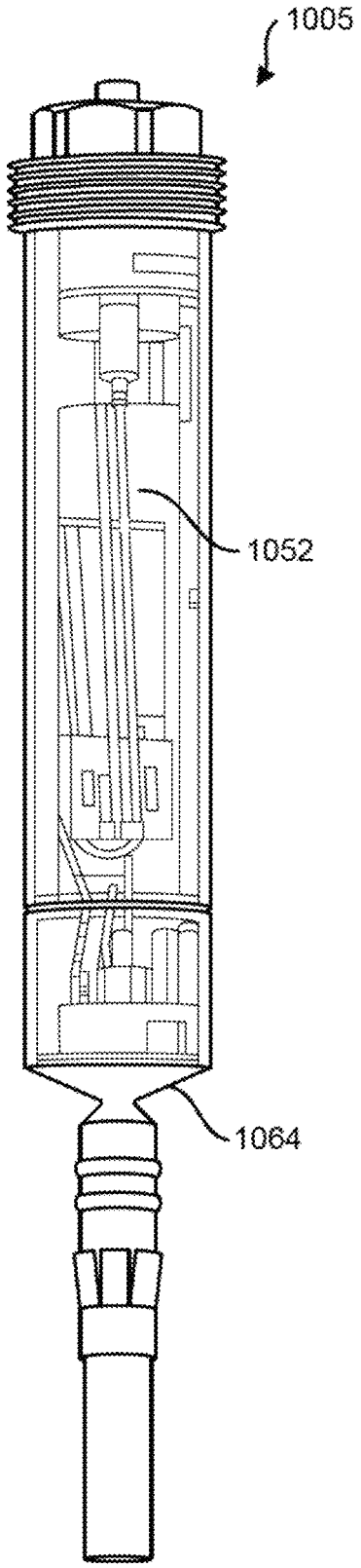
FIGS. 10A-10C are hidden, cross-sectional, and exploded views, respectively, of a locking version of the integrated igniter with a single switch assembly and an external propellant.
Figure 10B:
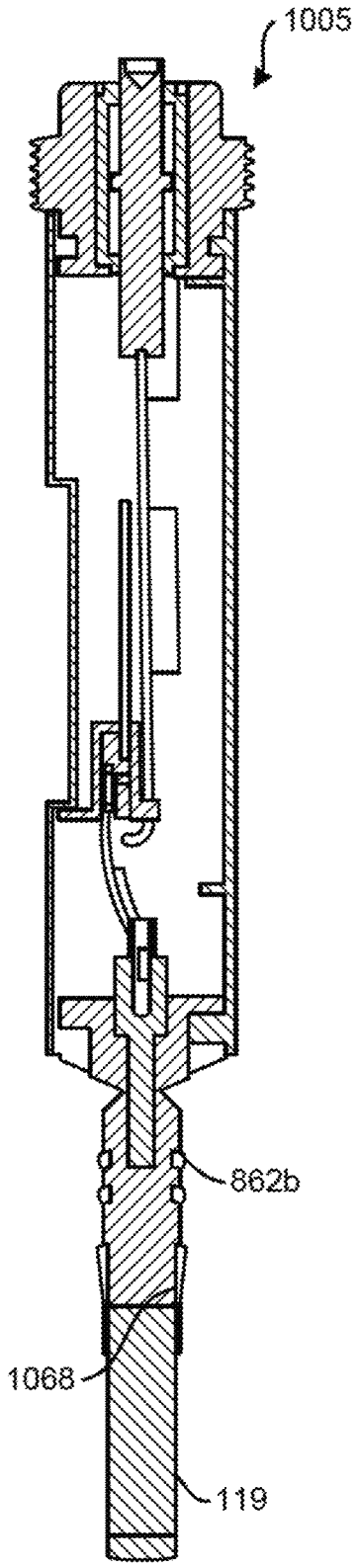
Figure 10C:
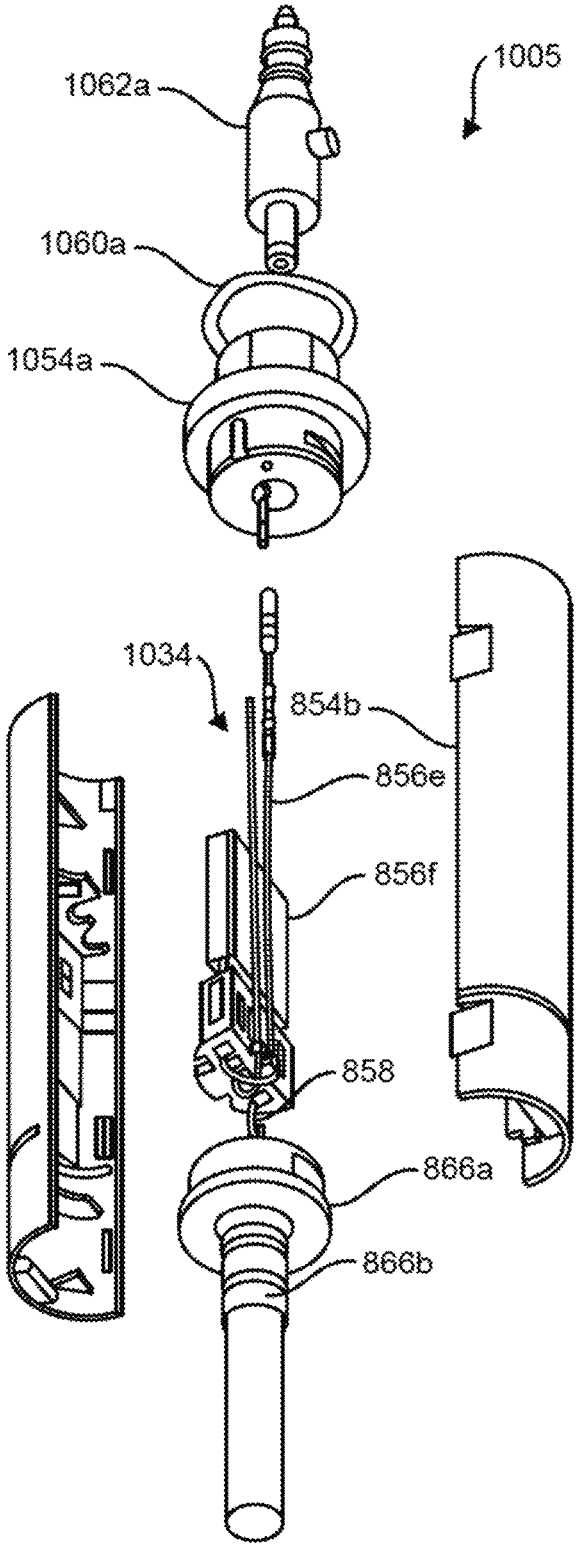

FIGS. 10A-10C are hidden, cross-sectional, and exploded views, respectively, of a locking (e.g., screw on) version of the igniter 1005 with the single switch assembly 1034 and an external propellant 119. This version has the propellant 119 in an external position outside of the igniter housing 1052.

Like the integrated igniters 805 of FIGS. 8A-8C and 905 of FIGS. 9A and 9B, this version includes an igniter housing 1052, the switch assembly 1034, and the external propellant 119. In this version, the igniter housing 1052 is a cylindrical member with the propellant 119 external thereto. A demonstrated by this version, the igniter housing 1052 may have different shapes, and may support the propellant 119 external from other components housed within the igniter housing 1052.

In this version, the igniter housing 1052 includes a bulkhead 1054*a* and igniter portions 1054*b*. The igniter portions 1054*b* are similar to the igniter portions 854*b* of FIGS. 8A-8C. An o-ring 1060*a* is positionable about the bulkhead 1054*a*. The bulkhead 1054*a* operates similar to the bulkheads 854*a* of FIGS. 8A-8C for communication via communication link 118 (FIG. 1).

The switch assembly 1034 is positioned within the igniter portions 1054*b*, and includes the same addressable switch 856*f*, single contact 858, and wires 856*e* of the switch assembly 834 of FIGS. 8A-8C. This switch assembly 1034 also includes a bulkhead feedthru 1062*a* and a nose feedthru 1062*b*. The bulkhead feedthru 1062*a* is extendable through the bulkhead 1054*a*. The wires 856*e* are electrically connectable to the bulkhead feedthru 1062*a* at one end and the single contact 858 at the other end. The single contact 858 is connectable to the nose feedthru 1062*b*. The bulkhead feedthru 1062*a* extends through the bulkhead 1054*a* for connection to the wires 856*e* at one end and to another downhole component, such as the perforating tool 116*d* for communication with the conveyance 110 and the surface unit 108 (FIG. 1).

This version may also employ locking means (e.g., a locking or screw or support) about the external propellant 119. This version is provided with a locking ring 1064 positioned at a downhole end of the igniter portions 1054*b*. The propellant 119 is secured to the housing 1052 by the locking ring 1064, and extends from an end of the igniter housing 1052 for insertion into the downhole tool (e.g., into the passage 211 of the release tool 103 (e.g., FIG. 2B)).

The locking ring 1064 may be used to secure the propellant 119 to the igniter 1005. The locking ring 1064 is a ring-shaped member including a housing portion 1066*a* and a nose portion 1066*b* extending downhole therefrom. The housing portion 1066*a* may be threaded for connection to the igniter portions 1054*b*. The housing portion 1066*a* may also have a hole to receive the nose feedthru 1062*b* therethrough.

The nose feedthru 1062*b* extends into the nose portion 1066*b* for connection to the switch assembly 1034. The nose portion 1066*b* has a nose receptacle 1068 for receivingly supporting the propellant 119 therein. Upon triggering of the switch assembly 1034, a signal passes from the switch assembly 1034 via the nose feedthru 1062*b* to ignite the propellant 119, thereby activating the downhole component (e.g., activating release tool 103 to detach the downhole portion 101*b* of the downhole tool 101 (FIG. 1)).

While specific configurations of the release tool and the integrated igniter integrated therewith are shown, it will be appreciated that various configurations of the integrated igniter and the release tool may be provided. It will also be appreciated that each of the igniters described herein may include one or more features of the other igniters described herein. For example, one or more wires, connectors, contacts, propellants, portions of housings, shapes of components, etc. can be provided.

Figure 11A:
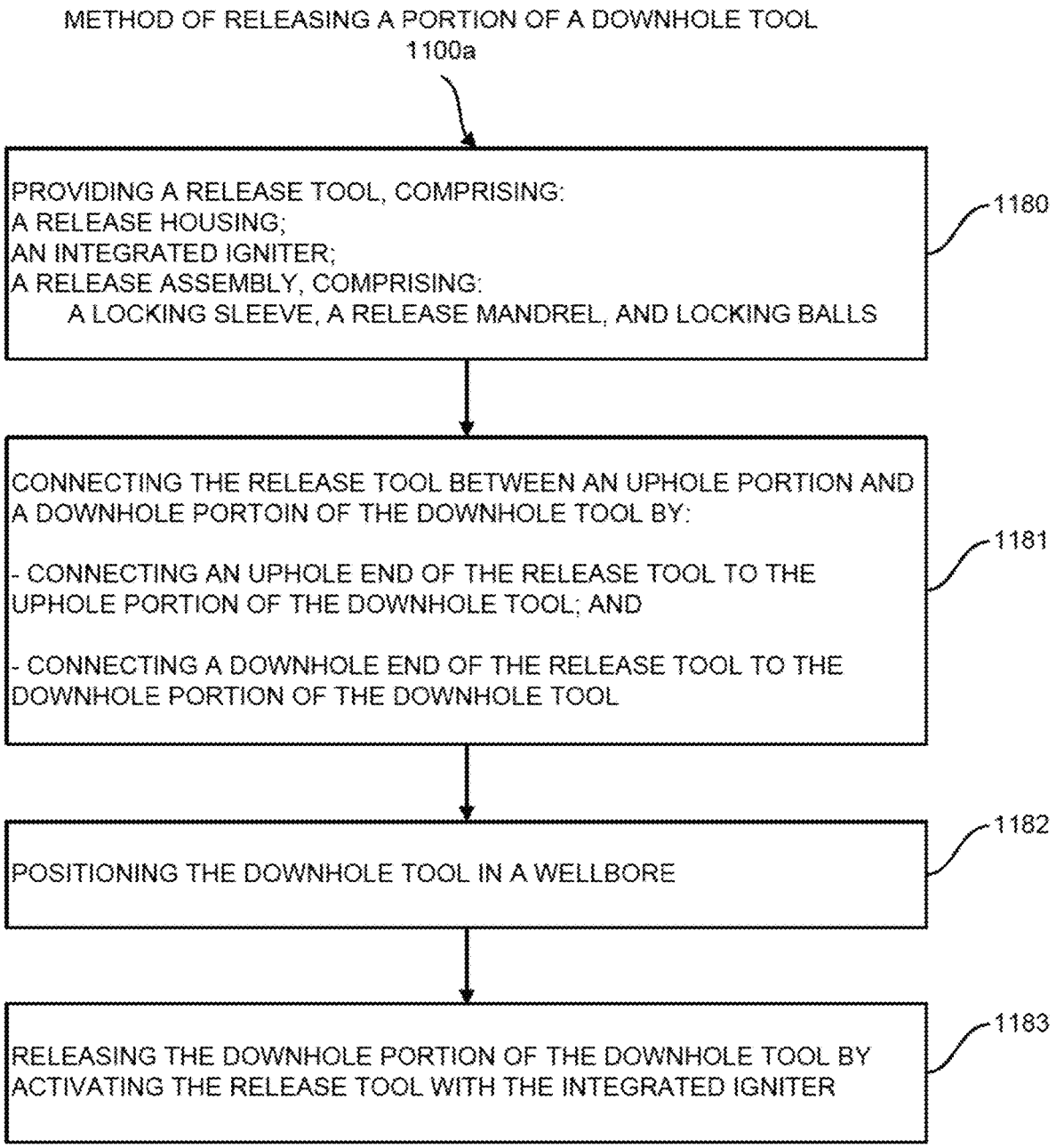
FIGS. 11A and 11B are flow charts depicting a method of releasing a portion of a downhole tool and a method of activating a downhole component, respectively.
Figure 11B:
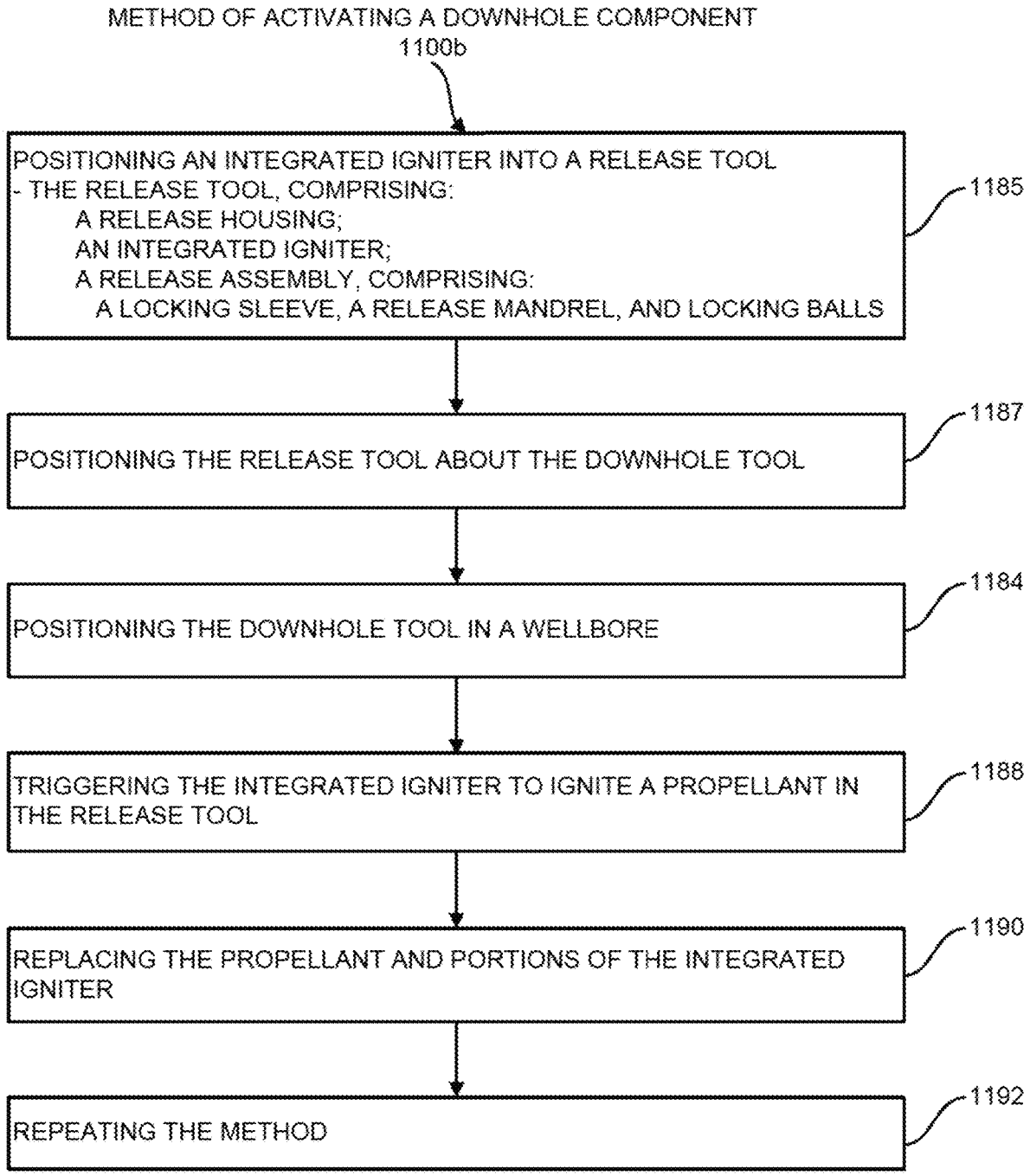

FIGS. 11A and 11B are flow charts depicting a method 1100*a* of releasing a portion of a downhole tool and a method 1100*b* of activating a downhole component, respectively. The method 1100*a* involves 1180—providing a release tool. The release tool may comprise a release housing; an integrated igniter; and a release assembly. The release assembly may comprise a locking sleeve, a release mandrel, and locking balls. The method 1100*a* further involves 1181—connecting the release tool between an uphole portion and a downhole portion of the downhole tool. This connecting may involve connecting an uphole end of the release tool to the uphole portion of the downhole tool; and connecting a downhole end of the release tool to the downhole portion of the downhole tool. The method 1100*a* further involves 1182—positioning the downhole tool in a wellbore and 1183—releasing the downhole portion of the downhole tool by activating the release tool with the integrated igniter.

The method 1100*b* involves 1180—positioning an integrated igniter into a release tool. The method 1100*b* further involves 1182—positioning the release tool about the downhole tool, 1184—positioning the downhole tool in a wellbore, and 1188—triggering the integrated igniter to ignite a propellant in the release tool. The method 1100*b* may further involve 1190—replacing the propellant and portions of the integrated igniter and 1192—repeating the method 1100*b*.

Part or all of the methods 1100*a,b* may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain tools and components are provided herein, it will be appreciated that various configurations (e.g., shape, order, orientation, etc.) of the tools and components herein may be used. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A release tool for releasing a downhole portion a of downhole tool, comprising:

a release housing having a passage therethrough;

a top sub positioned at an uphole end of the release housing, the top sub connected to an uphole portion of the downhole tool;

a bottom sub positioned at a downhole end of the release housing, the bottom sub connected to the downhole portion of the downhole tool;

a release assembly positioned in the passage, the release assembly comprising a release mandrel and a locking mechanism, the release mandrel operatively connected to the top sub and the bottom sub, the locking mechanism releasably securing the release assembly to the bottom sub; and an integrated igniter positioned in the passage, the integrated igniter comprising an integrator housing, a switch assembly, and an internal propellant, the switch assembly operatively connected to the internal propellant whereby, upon triggering the switch, the internal propellant is ignited to release an ignition fluid under ignition pressure to unlock the locking mechanism and release the downhole portion of the downhole tool from the uphole portion of the downhole tool;

wherein the locking mechanism comprises a locking sleeve and locking balls movable by the integrated ignitor between a locked position and an unlocked position; and wherein the release mandrel has ball receptacles radially disposed about a downhole end of the release mandrel and wherein the bottom sub has ball seats shaped to receive the locking balls.

2. The release tool of claim 1, wherein the locking sleeve is a tubular member slidably movable along an outer periphery of the release mandrel and along an inner surface of the release housing.

3. The release tool of claim 1, wherein the locking balls are movably positionable about the locking sleeve in response to movement of the locking sleeve.

4. The release tool of claim 1, wherein, in the locked position, the locking balls are seated in the ball seats, extend through the ball receptacles, and contact the locking sleeve.

5. The release tool of claim 1, wherein, in the unlocked position, the locking balls are radially away from the ball seats and against a ball surface of the locking sleeve.

6. The release tool of claim 1, wherein the top sub and the bottom sub are each connectable to a respective downhole component of the downhole tool.

7. The release tool of claim 1, wherein the release mandrel has an uphole end shaped for connection within the release housing and a downhole end shaped for receivingly connecting to the bottom sub.

8. The release tool of claim 1, wherein the release assembly further comprises a feedthru electrically connected to the top sub and the bottom sub.

9. The release tool of claim 8, wherein the feedthru is an electrical contact shaped for electrical contact with the integrated igniter at one end and the bottom sub at an opposite end.

10. The release tool of claim 1, wherein the release assembly further comprises a retainer spring, a disk spring, and a ball catch.

11. The release tool of claim 10, wherein the disk spring is a wave-shaped spring positioned about the release mandrel.

12. The release tool of claim 10, wherein the disk spring is positioned between the locking mechanism and the release mandrel.

13. The release tool of claim 1, wherein the release assembly further comprises a release housing nut, a retainer ring, and a sub feedthru.

14. The release tool of claim 1, wherein the release assembly further comprises a sleeve, a cap, and retaining pins.

15. The release tool of claim 1, wherein:

the igniter housing comprises an igniter portion and a nose portion, the igniter portion having a switch chamber therein, the nose portion having a propellant opening therethrough;

the switch assembly is positioned in the switch chamber, the switch assembly comprising a switch movable between an untriggered and a triggered position; and the propellant is supported by the nose portion, the propellant connected to the switch and the integrated ignited thereby when the switch is moved to the triggered position whereby the propellant releases a gas through the propellant opening to activate the release assembly.

16. A method of releasing a portion of a downhole tool, comprising:

providing the release tool of claim 1;

connecting an uphole end of the release tool to an uphole portion of the downhole tool and a downhole end of the release tool to a downhole portion of the downhole tool; and selectively releasing the downhole portion of the downhole tool by triggering the integrated ignitor to release a fluid under pressure to unlock the release assembly such that the downhole portion of the downhole tool is released from the uphole portion of the downhole tool.

17. The method of claim 16, further comprising positioning the downhole tool in a wellbore 104.

18. The method of claim 16, wherein the triggering comprises triggering the integrated igniter to ignite a propellant.

19. The method of claim 16, further comprising replacing portions of the integrated igniter.

20. A downhole tool, comprising:

an uphole portion;

a downhole portion; and a release tool, comprising:

a release housing having a passage therethrough;

a top sub positioned at an uphole end of the release housing, the top sub connected to the uphole portion of the downhole tool;

a bottom sub positioned at a downhole end of the release housing, the bottom sub connected to the downhole portion of the downhole tool;

a release assembly positioned in the passage, the release assembly comprising a release mandrel and a locking mechanism, the release mandrel operatively connected to the top sub and the bottom sub, the locking mechanism releasably securing the release assembly to the bottom sub; and an integrated igniter positioned in the passage, the integrated igniter comprising an integrator housing, a switch assembly, and an internal propellant, the switch assembly operatively connected to the internal propellant whereby, upon triggering the switch, the internal propellant is ignited to release an ignition fluid under ignition pressure to unlock the locking mechanism and release the downhole portion of the downhole tool from the uphole portion of the downhole tool;

wherein the locking mechanism comprises a locking sleeve and locking balls movable by the integrated ignitor between a locked position and an unlocked position; and wherein the release mandrel has ball receptacles radially disposed about a downhole end of the release mandrel and wherein the bottom sub has ball seats shaped to receive the locking balls.

21. The downhole tool of claim 20, wherein the downhole portion comprises a setting tool and a plug assembly.

* * * * *